US012601341B2

(12) United States Patent
Matsushita et al.

(10) Patent No.: US 12,601,341 B2
(45) Date of Patent: Apr. 14, 2026

(54) DIAPHRAGM PUMP ADJUSTMENT PORTION FOR ADJUSTING RESONANT FREQUENCY OF DIAPHRAGM

(71) Applicant: SONY GROUP CORPORATION, Tokyo (JP)

(72) Inventors: Takuma Matsushita, Tokyo (JP); Hiroshi Suzuki, Tokyo (JP); Hiroto Kawaguchi, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 231 days.

(21) Appl. No.: 18/255,125

(22) PCT Filed: Dec. 2, 2021

(86) PCT No.: PCT/JP2021/044200
§ 371 (c)(1),
(2) Date: May 31, 2023

(87) PCT Pub. No.: WO2022/124176
PCT Pub. Date: Jun. 16, 2022

(65) Prior Publication Data

US 2024/0026871 A1 Jan. 25, 2024

(30) Foreign Application Priority Data

Dec. 9, 2020 (JP) ..... 2020-204122

(51) Int. Cl.
*F04B 43/04* (2006.01)
*F04B 17/00* (2006.01)
*F04B 45/047* (2006.01)

(52) U.S. Cl.
CPC ..... *F04B 43/046* (2013.01); *F04B 43/04* (2013.01); *F04B 45/047* (2013.01); *F04B 17/003* (2013.01)

(58) Field of Classification Search
CPC ..... F04B 43/02; F04B 43/04; F04B 43/046; F04B 43/047; F04B 45/047; F04B 17/003
See application file for complete search history.

(56) References Cited

U.S. PATENT DOCUMENTS 6,164,933 A * 12/2000 Tani ..... A61B 5/0235 417/440
6,869,275 B2 * 3/2005 Dante ..... F04B 43/046 417/322

(Continued)

FOREIGN PATENT DOCUMENTS

JP 2002-022762 A 1/2002
JP 2003-139064 A 5/2003

(Continued)

OTHER PUBLICATIONS

International Search Report and Written Opinion of PCT Application No. PCT/JP2021/044200, issued on Jan. 25, 2022, 13 pages of ISRWO.

*Primary Examiner* — Nathan C Zollinger
(74) *Attorney, Agent, or Firm* — CHIP LAW GROUP

(57) ABSTRACT

[Object] To provide a technology or the like capable of improving driving efficiency of a diaphragm pump.
[Solving Means] A diaphragm pump (10) according to the present technology includes a first diaphragm (1*a*), a second diaphragm (1*b*), and an adjustment portion (11). The first diaphragm (1*a*) includes a first member including a first elastic portion (5*a*), and a first drive unit that elastically deforms the first elastic portion (5*a*) by drive of the first drive unit. The second diaphragm (1*b*) includes a second member that includes a second elastic portion (5*b*) and forms a space (13) with the first member, a fluid flowing in the space, and a second drive unit that elastically deforms the second elastic portion (5*b*). The adjustment portion (11) is provided to at least one of the first diaphragm (1*a*) or the (Continued)

second diaphragm (1*b*) and is for adjusting a resonant frequency of the at least one of the first diaphragm (1*a*) or the second diaphragm (1*b*).

7 Claims, 16 Drawing Sheets

(56) References Cited

U.S. PATENT DOCUMENTS

| | | | | |
|---|---|---|---|---|
| 7,191,503 | B2 * | 3/2007 | East | H10N 30/802 29/25.35 |
| 11,938,515 | B2 * | 3/2024 | Goericke | B06B 1/0688 |
| 12,226,801 | B2 * | 2/2025 | Shelton | B06B 1/0651 |

FOREIGN PATENT DOCUMENTS

| | | | | |
|---|---|---|---|---|
| JP | 2007-036670 | A | 2/2007 | |
| JP | 2008-182866 | A | 8/2008 | |
| JP | 2010-121539 | A | 6/2010 | |
| JP | 2016-514050 | A | 5/2016 | |
| JP | 2019-031946 | A | 2/2019 | |
| WO | 2012/140967 | A1 | 10/2012 | |
| WO | WO-2019126729 | A1 * | 6/2019 | B06B 1/0688 |
| WO | WO-2021049460 | A1 * | 3/2021 | F04B 39/121 |

* cited by examiner

DIAPHRAGM PUMP ADJUSTMENT PORTION FOR ADJUSTING RESONANT FREQUENCY OF DIAPHRAGM

CROSS REFERENCE TO RELATED APPLICATIONS

This application is a U.S. National Phase of International Patent Application No. PCT/JP2021/044200 filed on Dec. 2, 2021, which claims priority benefit of Japanese Patent Application No. JP 2020-204122 filed in the Japan Patent Office on Dec. 9, 2020. Each of the above-referenced applications is hereby incorporated herein by reference in its entirety.

TECHNICAL FIELD

The present technology relates to a technology of a diaphragm pump and the like.

BACKGROUND ART

For small and thin pumps, a diaphragm pump using a diaphragm is put into practical use (see, e.g., Patent Literature 1 below). In the diaphragm pump, when a volumetric capacity of a pump chamber increases by bending deformation of a diaphragm, a fluid is taken in the pump chamber. Meanwhile, when the volumetric capacity of the pump chamber decreases, the fluid is discharged from the pump chamber.

CITATION LIST

Patent Literature

Patent Literature 1: Japanese Patent Application Laid-open No. 2010-121539

DISCLOSURE OF INVENTION

Technical Problem

There is a need for a technology capable of improving driving efficiency of a diaphragm pump.

In view of the circumstances as described above, it is an object of the present technology to provide a technology or the like capable of improving driving efficiency of a diaphragm pump.

Solution to Problem

A diaphragm pump according to the present technology includes a first diaphragm, a second diaphragm, and an adjustment portion.

The first diaphragm includes a first member including a first elastic portion, and a first drive unit that elastically deforms the first elastic portion by drive of the first drive unit.

The second diaphragm includes a second member that includes a second elastic portion and forms a space with the first member, a fluid flowing in the space, and a second drive unit that elastically deforms the second elastic portion.

The adjustment portion is provided to at least one of the first diaphragm or the second diaphragm and is for adjusting a resonant frequency of the at least one of the first diaphragm or the second diaphragm.

As described above, the present technology includes the adjustment portion, so that the resonant frequencies of the first diaphragm and the second diaphragm can be equalized as much as possible. This makes it possible to improve driving efficiency of the diaphragm pump.

An electronic apparatus according to the present technology includes a diaphragm pump.

The diaphragm pump includes a first diaphragm, a second diaphragm, and an adjustment portion.

The first diaphragm includes a first member including a first elastic portion, and a first drive unit that elastically deforms the first elastic portion by drive of the first drive unit.

The second diaphragm includes a second member that includes a second elastic portion and forms a space with the first member, a fluid flowing in the space, and a second drive unit that elastically deforms the second elastic portion by drive of the second drive unit.

The adjustment portion is provided to at least one of the first diaphragm or the second diaphragm and is for adjusting a resonant frequency of the at least one of the first diaphragm or the second diaphragm.

A manufacturing apparatus for a diaphragm pump according to the present technology includes an adjustment portion formation unit.

The adjustment portion formation unit forms an adjustment portion for adjusting a resonant frequency of at least one of a first diaphragm or a second diaphragm on at least one of the first diaphragm or the second diaphragm, the first diaphragm including a first member including a first elastic portion, and a first drive unit that elastically deforms the first elastic portion by drive of the first drive unit, the second diaphragm including a second member that includes a second elastic portion and forms a space with the first member, a fluid flowing in the space, and a second drive unit that elastically deforms the second elastic portion by drive of the second drive unit.

A manufacturing method for a diaphragm according to the present technology includes:

- preparing
  - a first diaphragm including
    - a first member including a first elastic portion, and
    - a first drive unit that elastically deforms the first elastic portion by drive of the first drive unit, and
  - a second diaphragm including
    - a second member that includes a second elastic portion and forms a space with the first member, a fluid flowing in the space, and
    - a second drive unit that elastically deforms the second elastic portion by drive of the second drive unit; and
- forming an adjustment portion for adjusting a resonant frequency of at least one of the first diaphragm or the second diaphragm on at least one of the first diaphragm or the second diaphragm.

MODE(S) FOR CARRYING OUT THE INVENTION

Hereinafter, embodiments according to the present technology will be described with reference to the drawings.

First Embodiment

<Overall Configuration and Configuration of Each Unit>

Figure 1:
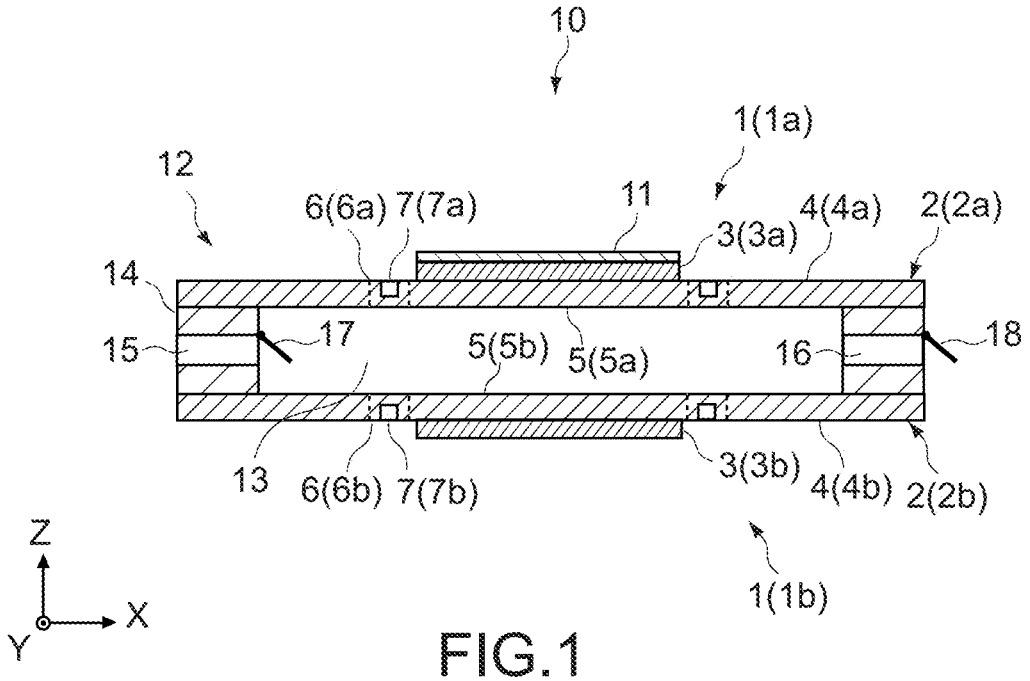
FIG. 1 is a side cross-sectional view of a diaphragm pump according to a first embodiment of the present technology.
Figure 2:
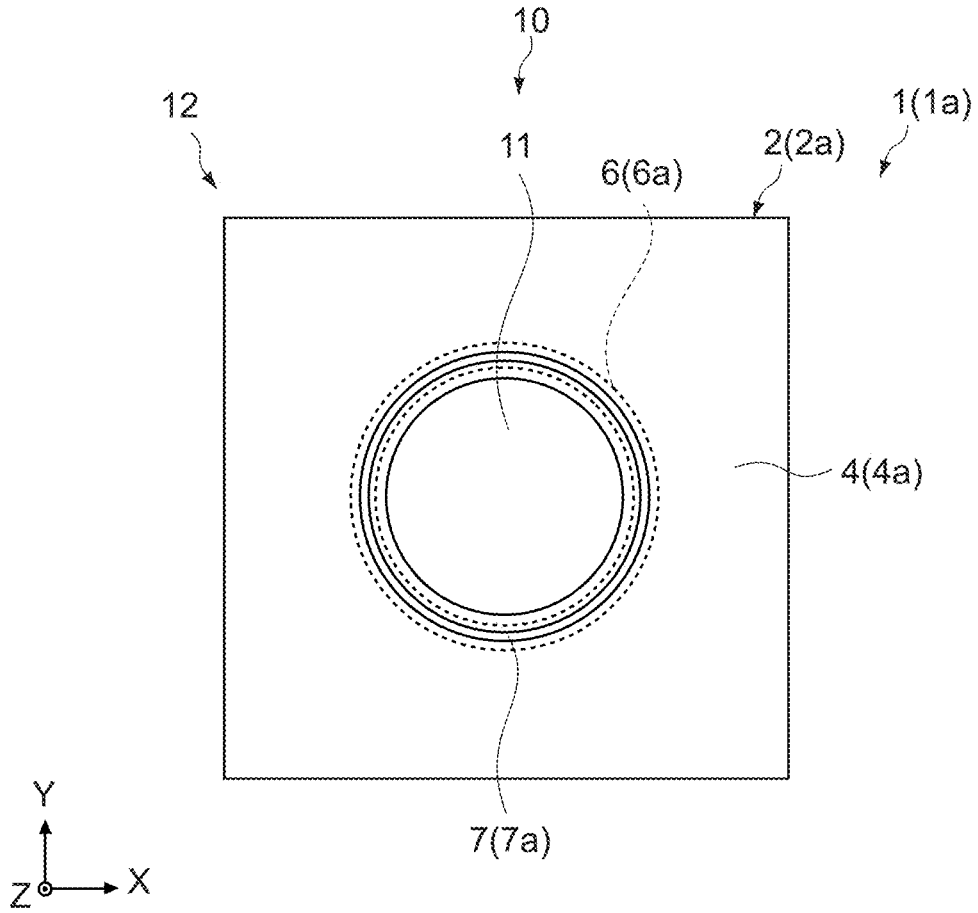
FIG. 2 is a top view of the diaphragm pump.

FIG. 1 is a side cross-sectional view of a diaphragm pump according to a first embodiment of the present technology. FIG. 2 is a top view of the diaphragm pump 10.

As shown in those figures, the diaphragm pump 10 includes a first diaphragm 1*a* and a second diaphragm 1*b* that are disposed to face each other. Additionally, the diaphragm pump 10 further includes an adjustment portion 11 for adjusting a resonant frequency (eigenvalue) of the first diaphragm 1*a* and the second diaphragm 1*b*.

The diaphragm pump 10 is configured to be capable of taking in and discharging a fluid by drive of the first diaphragm 1*a* and the second diaphragm 1*b*. Note that a fluid used in the diaphragm pump 10 may be gas such as air or liquid such as water.

The first diaphragm 1*a* includes a flat plate-like first plate member 2*a* (first member) and a first piezoelectric element 3*a* (first drive unit) that bends and deforms the first plate member 2*a* (first elastic portion 5*a*) vertically by the drive thereof. The second diaphragm 1*b* includes a flat plate-like second plate member 2*b* (second member) that forms a space 13 for holding a fluid with the first plate member 2*a*, and a second piezoelectric element 3*b* (second drive unit) that bends and deforms the second plate member 2*b* (second elastic portion vertically by the drive thereof.

The first piezoelectric element 3*a* and the second piezoelectric element 3*b* are each formed of a piezoelectric material such as PZT. The first piezoelectric element 3*a* is provided in the vicinity of the center of the first plate member 2*a* in the upper portion of the first plate member 2*a*. The second piezoelectric element 3*b* is provided in the vicinity of the center of the second plate member 2*b* in the lower portion of the second plate member 2*b*. Note that each of the first piezoelectric element 3*a* and the second piezoelectric element 3*b* may have a laminated structure of two or more layers.

In this example, the first piezoelectric element 3*a* and the second piezoelectric element 3*b* have a circular shape in plan view, but may be configured to have a shape such as an oval shape or a polygonal shape in plan view or may be configured to have an annular shape.

The first plate member 2*a* of the first diaphragm 1*a* and the second plate member 2*b* of the second diaphragm 1*b* are formed of various materials such as resin and metal. In the example shown in FIG. 2, the first plate member 2*a* and the second plate member 2*b* each have a rectangular shape in plan view, but may have a circular shape or a polygonal shape other than a rectangular shape, and the shape thereof is not particularly limited.

The first plate member 2*a* includes a first fixing portion 4*a* located on the outer circumferential side, a first elastic portion 5*a* provided on the lower side of the first piezoelectric element 3*a* at a position corresponding to the first piezoelectric element 3*a*, and a first spring portion 6*a* interposed between the first fixing portion 4*a* and the first elastic portion 5*a*.

Similarly, the second plate member 2*b* includes a second fixing portion 4*b* located on the outer circumferential side, a second elastic portion 5*b* provided on the upper side of the second piezoelectric element 3*b* at a position corresponding to the second piezoelectric element 3*b*, and a first spring portion 6*a* interposed between the second fixing portion 4*b* and the first elastic portion 5*a*.

The first fixing portion 4*a* and the second fixing portion 4*b* are fixed ends, and when the diaphragm pump 10 is attached to another device such as an electronic apparatus, a prat or all of the fixed ends are fixed at the attachment positions thereof as necessary.

Note that examples of an electronic apparatus on which the diaphragm pump 10 is mounted include a personal computer (PC), a mobile phone (including a smartphone), a wearable device, and a haptic device, but the type of the electronic apparatus is not particularly limited (e.g., the diaphragm pump 10 is used as a cooling device).

The first elastic portion 5*a* is elastically deformable and is vertically bendable by the first piezoelectric element 3*a*. Similarly, the second elastic portion 5*b* is elastically deformable and is vertically bendable by the second piezoelectric element 3*b*. In the example shown in the figure, the first elastic portion 5*a* and the second elastic portion 5*b* are circular in plan view (because the first piezoelectric element 3*a* and the second piezoelectric element 3*b* are circular), but may have a polygonal shape or the like, and the shape thereof is not particularly limited.

The first spring portion 6*a* is capable of promoting elastic deformation of the first elastic portion 5*a*. Similarly, the second spring portion 6*b* is capable of promoting elastic deformation of the second elastic portion 5*b*.

The first spring portion 6*a* is formed by a first groove 7*a* provided along the circumferential direction, on the upper side of the first plate member 2*a* and in the circumference of the first elastic portion 5*a*. Similarly, the second spring portion 6*b* is formed by a second groove 7*b* provided along the circumferential direction, on the lower side of the second plate member 2*b* and in the circumference of the second elastic portion 5*b*. Note that, in the example shown in FIG. 2, the first groove 7*a* and the second groove 7*b* are provided over the entire circumference in the circumferential direction, but the first groove 7*a* and the second groove 7*b* may be intermittently provided at regular intervals along the circumferential direction.

Further, in the example shown in FIG. 2, the first spring portion 6*a* and the second spring portion 6*b* are circular and annular in plan view (because the first piezoelectric element 3*a* and the second piezoelectric element 3*b* are circular), but may have an annular shape such as a polygonal shape, and the shape thereof is not particularly limited.

Note that, in this embodiment, the first plate member 2*a* itself is formed of the same material, and thus the first fixing portion 4*a*, the first elastic portion 5*a*, and the first spring portion 6*a* are formed of the same material in this embodiment. Meanwhile, the first fixing portion 4*a*, the first elastic portion 5*a*, and the first spring portion 6*a* may be formed of different materials.

For example, the first fixing portion 4*a* is formed of a material having a higher rigidity than that of the first elastic portion 5*a* and the first spring portion 6*a*. Meanwhile, the first elastic portion 5*a* may be formed of a material having a higher elastic modulus than that of the first fixing portion 4*a*, and the first spring portion 6*a* may be formed of a material having a still higher elastic modulus than that of the first elastic portion 5*a*. This also applies to the second fixing portion 4*b*, the second elastic portion 5*b*, and the second spring portion 6*b*.

The diaphragm pump 10 includes a casing 12 that includes the space 13 capable of holding a fluid therein. The casing 12 is constituted by the first plate member 2*a* of the first diaphragm 1*a*, the second plate member 2*b* of the second diaphragm 1*b*, and a cylindrical body 14 interposed between the first plate member 2*a* and the second plate member 2*b*. Note that the casing 12 may be provided with a lid for covering the first diaphragm 1*a* and the second diaphragm 1*b*, though not shown in the figure.

The cylindrical body 14 includes an inlet 15 for causing a fluid to flow in the space 13 from the outside, and an outlet 16 for causing the fluid to flow out from the space 13 to the outside. The inlet 15 and the outlet 16 are each provided so as to pass through the cylindrical body 14 in the horizontal direction. Further, the inlet 15 and the outlet 16 are provided at the positions opposite to each other with the space 13 being sandwiched therebetween.

In the cylindrical body 14, a first check valve 17 is provided at a position corresponding to the inlet 15, whereas a second check valve 18 is provided at a position corresponding to the outlet 16. The first check valve 17 is provided on the inner circumferential side of the cylindrical body 14, whereas the second check valve 18 is provided on the outer circumferential side of the cylindrical body 14.

Note that, in this embodiment, the inlet 15 and the outlet 16 are provided in a direction perpendicular to the vibration direction of the diaphragm 1, but the inlet 15 and the outlet 16 may be provided in a direction parallel to the vibration direction of the diaphragm 1. In this case, for example, the inlet 15 and the outlet 16 are provided so as to vertically pass through the first diaphragm 1*a* (or the second diaphragm 1*b*), for example, at the first fixing portion 4*a* of the first diaphragm 1*a* (or the second fixing portion 4*b* of the second diaphragm 1*b*).

In this embodiment, the adjustment portion 11 is provided to only one of the first piezoelectric element 3*a* and the second piezoelectric element 3*b*. Note that the adjustment portion 11 may be provided to both the first piezoelectric element 3*a* and the second piezoelectric element 3*b*.

The adjustment portion 11 is capable of adjusting a resonant frequency (eigenvalue) of the first diaphragm 1*a* and the second diaphragm 1*b*. In this embodiment, the adjustment portion 11 is used to equalize the resonant frequencies of the first diaphragm 1*a* and the second diaphragm 1*b* as much as possible, thus improving the driving efficiency of the diaphragm pump 10.

The adjustment portion 11 is formed of, for example, a potting material by potting processing. Examples of the potting material include various resins such as a urethane resin, an epoxy resin, and a silicon resin, and various metals such as solder, but the potting material is not limited thereto. Note that the adjustment portion 11 may be formed by other methods such as coating, screen printing, and sputtering. In this case as well, the adjustment portion 11 is formed of various resins, various metals, and the like.

In the example shown in the figure, the adjustment portion 11 is provided so as to cover the entire region of the first piezoelectric element 3*a* on the first piezoelectric element 3*a*. Meanwhile, the adjustment portion 11 may be provided so as to cover a part of the region of the first piezoelectric element 3*a* on the first piezoelectric element 3*a* or may be provided so as to be separated into a plurality of parts in a scattered manner.

Description on Operation

Figure 3:
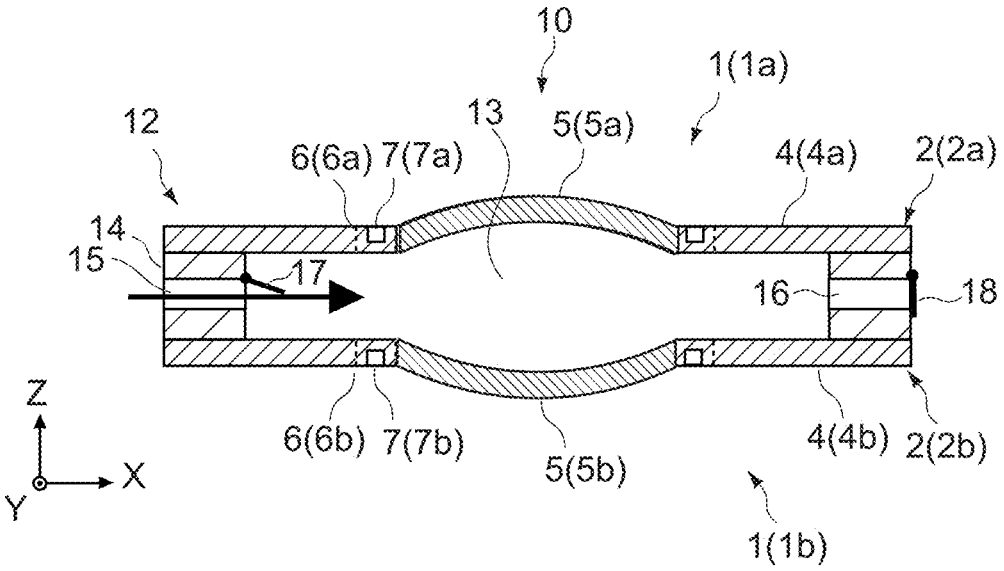
FIG. 3 is a view for describing the operation of the diaphragm pump.
Figure 4:
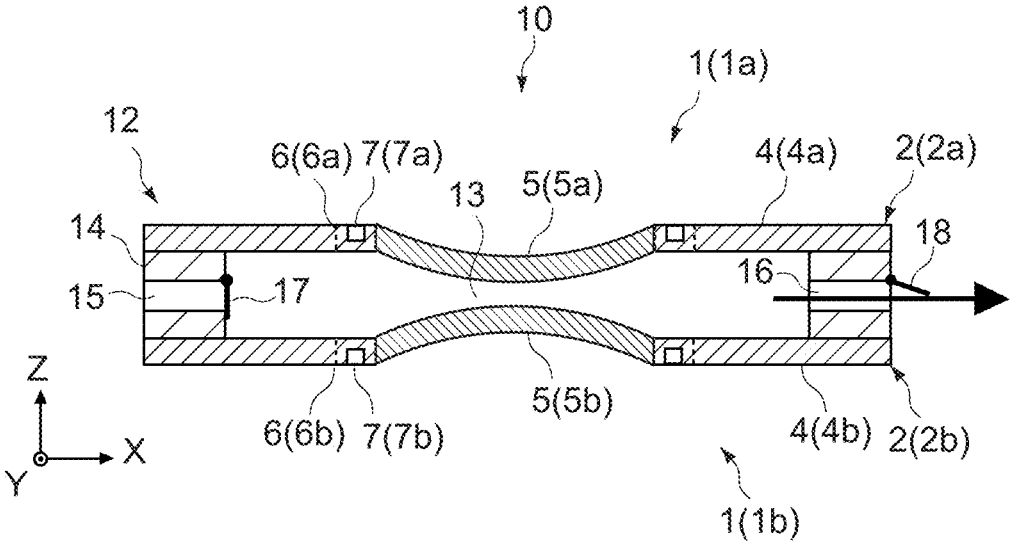
FIG. 4 is a view for describing the operation of the diaphragm pump.

Next, a typical operation of the diaphragm pump 10 will be described. FIGS. 3 and 4 are views for describing the operation of the diaphragm pump 10. Note that, in FIGS. 3 and 4, the illustration of the first piezoelectric element 3*a*, the second piezoelectric element 3*b*, and the adjustment portion 11 is omitted.

As shown in FIG. 3, when input voltages with the opposite phases (referred to as sine waves, triangular waves, rectangular waves, sawtooth waves, and the like; hereinafter collectively referred to as sine waves and the like) are applied to the first piezoelectric element 3*a* and the second piezoelectric element 3*b*, the first elastic portion 5*a* bens and deforms toward the upper side, and the second elastic portion 5*b* bens and deforms toward the lower side. At that time, the first spring portion 6*a* promotes the deformation of the first elastic portion 5*a*, and the first elastic portion 5*a* largely bends and deforms toward the upper side. Similarly, the second spring portion 6*b* promotes the deformation of the second elastic portion 5*b*, and the first elastic portion 5*a* largely bends and deforms toward the lower side.

When the first elastic portion 5*a* bens and deforms toward the upper side, and the second elastic portion 5*b* bens and deforms toward the lower side, the space 13 inside the casing 12 expands, and the pressure inside the space 13 is made smaller than that of the outside. Thus, a fluid flows in the space 13 from the outside via the inlet 15. Note that, at that time, the first check valve 17 provided to the inlet 15 is opened due to a difference in pressure between the outside and the inside of the space 13, whereas the second check valve 18 provided to the outlet 16 is closed due to the difference in pressure between the outside and the inside of the space 13.

When the input voltages with the opposite phases (sine waves and the like) are applied to the first piezoelectric element 3*a* and the second piezoelectric element 3*b* continuously from the state shown in FIG. 3, the first elastic portion 5*a* bens and deforms toward the lower side, and the second elastic portion 5*b* bens and deforms toward the upper side. At that time, the first spring portion 6*a* promotes the deformation of the first elastic portion 5*a*, and the first elastic portion 5*a* largely bends and deforms toward the lower side. Similarly, the second spring portion 6*b* promotes the deformation of the second elastic portion 5*b*, and the first elastic portion 5*a* largely bends and deforms toward the upper side.

When the first elastic portion 5*a* bens and deforms toward the lower side, and the second elastic portion 5*b* bens and deforms toward the upper side, the space 13 inside the casing 12 contracts, and the pressure inside the space 13 is made larger than that of the outside. Thus, the fluid flows out from the inside of the space 13 to the outside via the outlet 16. Note that, at that time, the first check valve 17 provided to the inlet 15 is closed due to the difference in pressure between the outside and the inside of the space 13, whereas the second check valve 18 provided to the outlet 16 is opened due to the difference in pressure between the outside and the inside of the space 13.

<Basic Concept of Present Technology>

Next, a basic concept of the present technology will be described.

Figure 5:
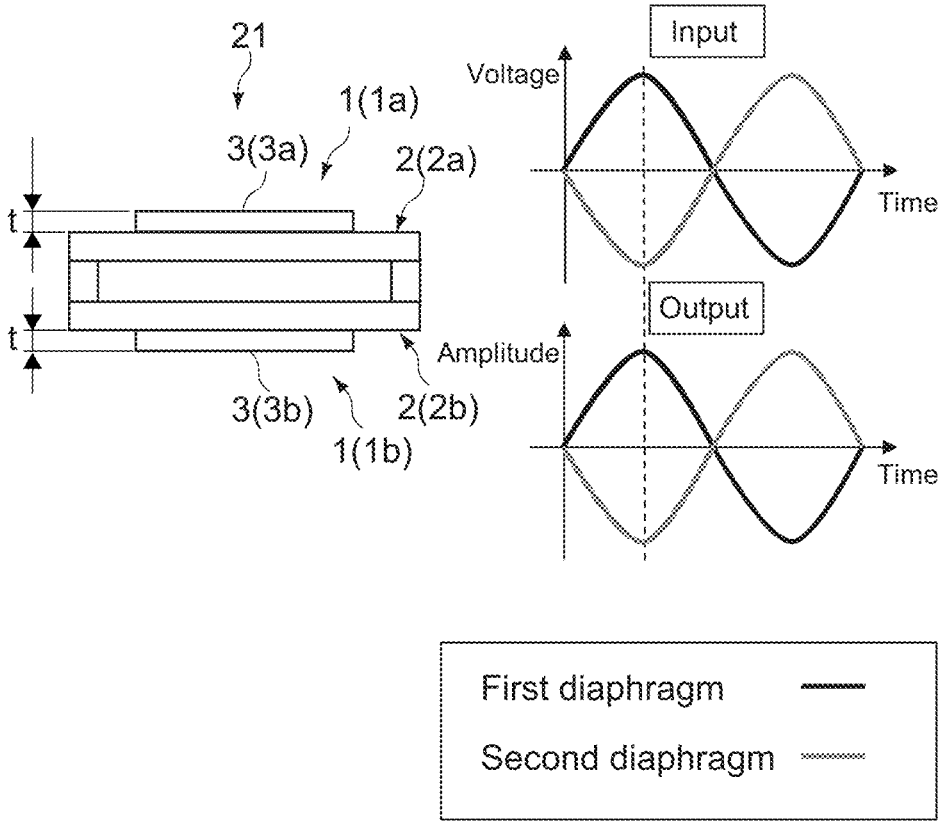
FIG. 5 is a schematic diagram of a diaphragm pump according to a first comparative example.

FIG. 5 is a schematic diagram of a diaphragm pump 21 according to a first comparative example. Note that FIG. 5 illustrates a simplified diaphragm pump 21. Such a first comparative example is different from this embodiment and does not include the adjustment portion 11.

Further, the first comparative example is a theoretically ideal diaphragm pump 21, in which a resonant frequency of a first diaphragm 1*a* and a resonant frequency of a second diaphragm 1*b* completely coincide with each other. For example, the size (X and Y directions) and a thickness t (Z direction) of a first piezoelectric element 3*a* and the size and a thickness t of a second piezoelectric element 3*b* completely coincide with each other, and the size and thickness of a first plate member 2*a* and the size and thickness of a second plate member 2*b* completely coincide with each other, so that resonant frequencies of the first diaphragm 1*a* and the second diaphragm 1*b* completely coincide with each other.

In such a diaphragm pump 21 according to the first comparative example, it is assumed that input voltages with the opposite phases (sine waves and the like) are applied to the first piezoelectric element 3*a* and the second piezoelectric element 3*b*. In this case, at the output, the first diaphragm 1*a* (first elastic portion 5*a*) and the second diaphragm 1*b* (second elastic portion 5*b*) have vibrations with ideally opposite phases due to the bending deformation thereof, and the time at which the amplitude has the maximum point is the same. This makes it possible to drive the diaphragm pump 21 with the maximum efficiency.

Figure 6:
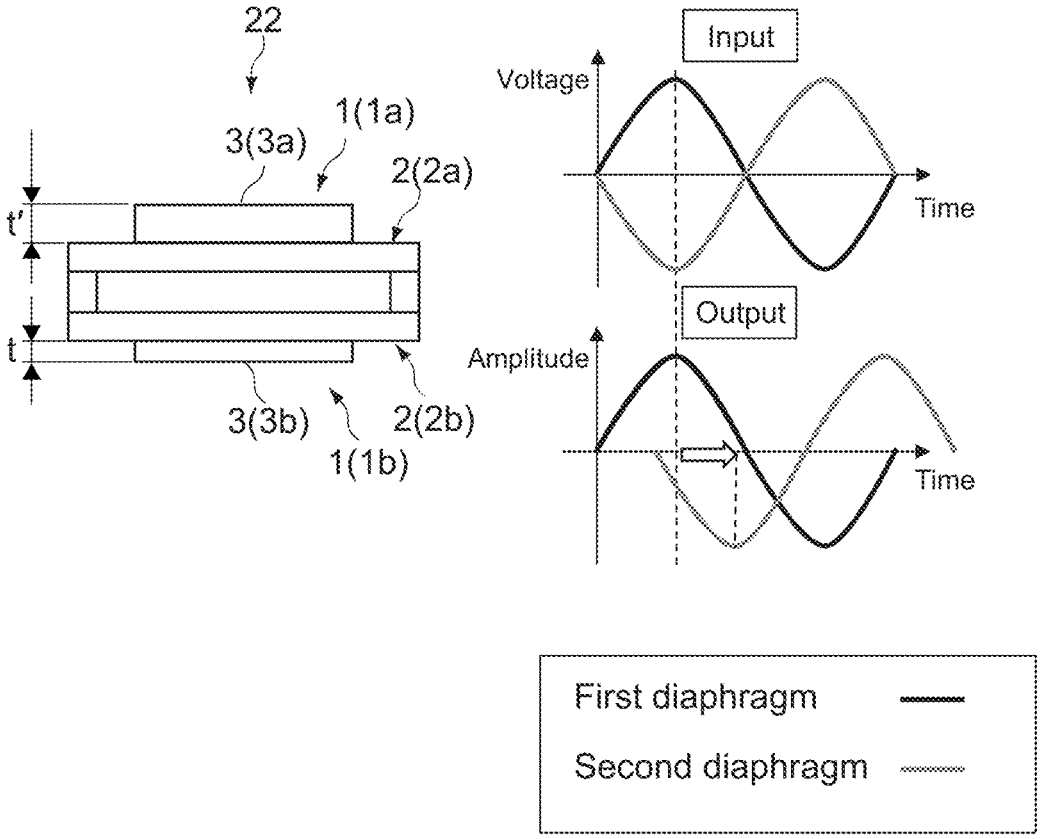
FIG. 6 a schematic diagram of a diaphragm pump according to a second comparative example.

FIG. 6 is a schematic diagram of a diaphragm pump 22 according to a second comparative example. Note that FIG. 6 illustrates a simplified diaphragm pump 22. Such a second comparative example is different from this embodiment and does not include the adjustment portion 11. Further, in such a second comparative example, a resonant frequency of a first diaphragm 1*a* and a resonant frequency of a second diaphragm 1*b* do not coincide with each other.

Here, since it is actually impossible to manufacture the first diaphragm 1*a* and the second diaphragm 1*b* that are completely the same, generally, the resonant frequency of the first diaphragm 1*a* and the resonant frequency of the second diaphragm 1*b* do not coincide with each other.

For example, due to the variations in manufacturing, a first piezoelectric element 3*a* and a second piezoelectric element 3*b* may be different in the size (X and Y directions) and thickness (Z direction) thereof. Further, a first plate member 2*a* and a second plate member 2*b* may be different in the size and thickness thereof. For example, due to such variations, the resonant frequency of the first diaphragm 1*a* and the resonant frequency of the second diaphragm 1*b* may differ.

Note that FIG. 6 shows, as an example, a state in which a first thickness t' of the first piezoelectric element 3*a* is thicker than a thickness t of the second piezoelectric element 3*b*.

In such a diaphragm pump 22 according to the second comparative example, it is assumed that input voltages with opposite phases (sine waves and the like) are applied to the first piezoelectric element 3*a* and the second piezoelectric element 3*b*. In this case, at the output, the first diaphragm 1*a* (first elastic portion 5*a*) and the second diaphragm 1*b* (second elastic portion 5*b*) have the vibration phases shifted due to the bending deformation thereof from the opposite phases, and the time at which the amplitude has the maximum point differs. This makes it difficult to efficiently drive the diaphragm pump 10.

For that reason, in this embodiment, the adjustment portion 11 for adjusting a resonant frequency is provided to one of (or may be both of) the first diaphragm 1*a* and the second diaphragm 1*b*. Thus, the resonant frequency of the first diaphragm 1*a* and the resonant frequency of the second diaphragm 1*b* are equalized as much as possible, and thus the driving efficiency of the diaphragm pump 10 is improved.

<Manufacturing Apparatus 30 and Manufacturing Method>

Next, a manufacturing apparatus 30 and a manufacturing method for the diaphragm pump 10 will be described.

Figure 7:
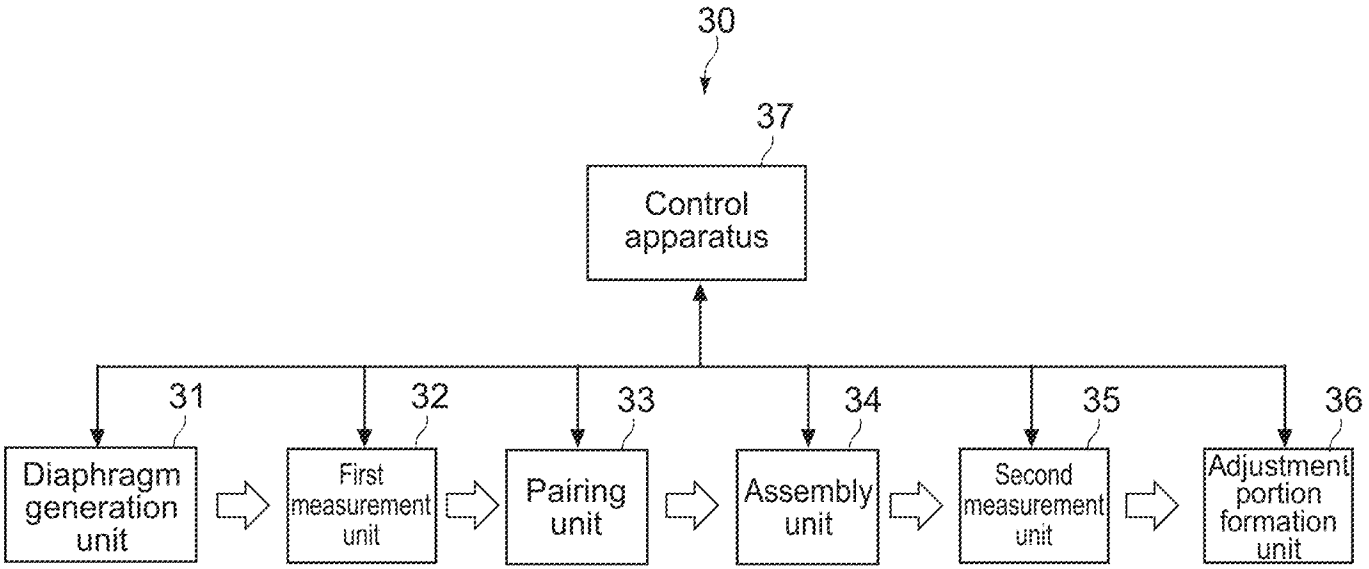
FIG. 7 is a diagram showing a manufacturing apparatus for the diaphragm pump according to the first embodiment.
Figure 8A:
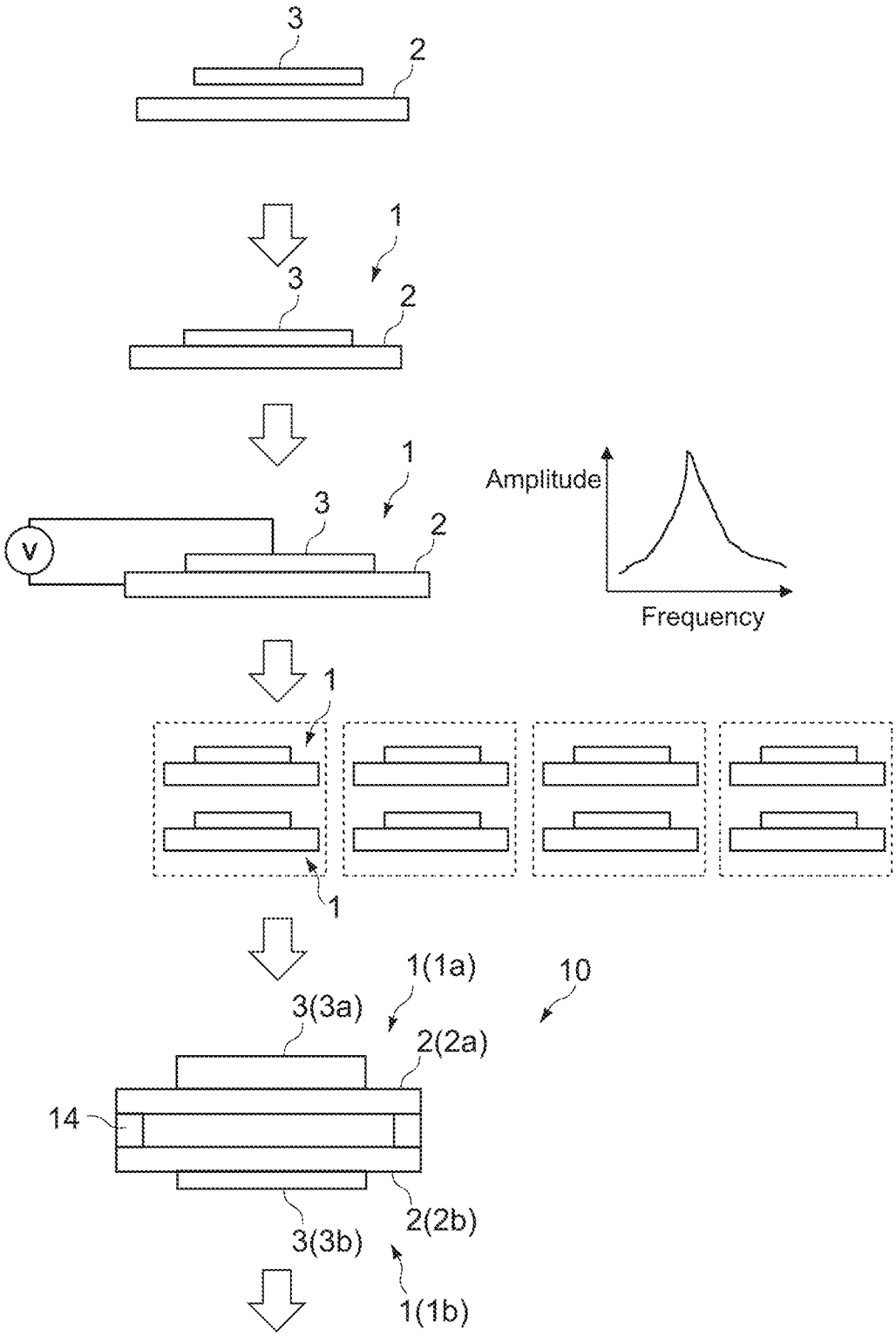
FIG. 8A is a diagram showing a manufacturing method for the diaphragm pump according to the first embodiment (manufacturing process).
Figure 8B:
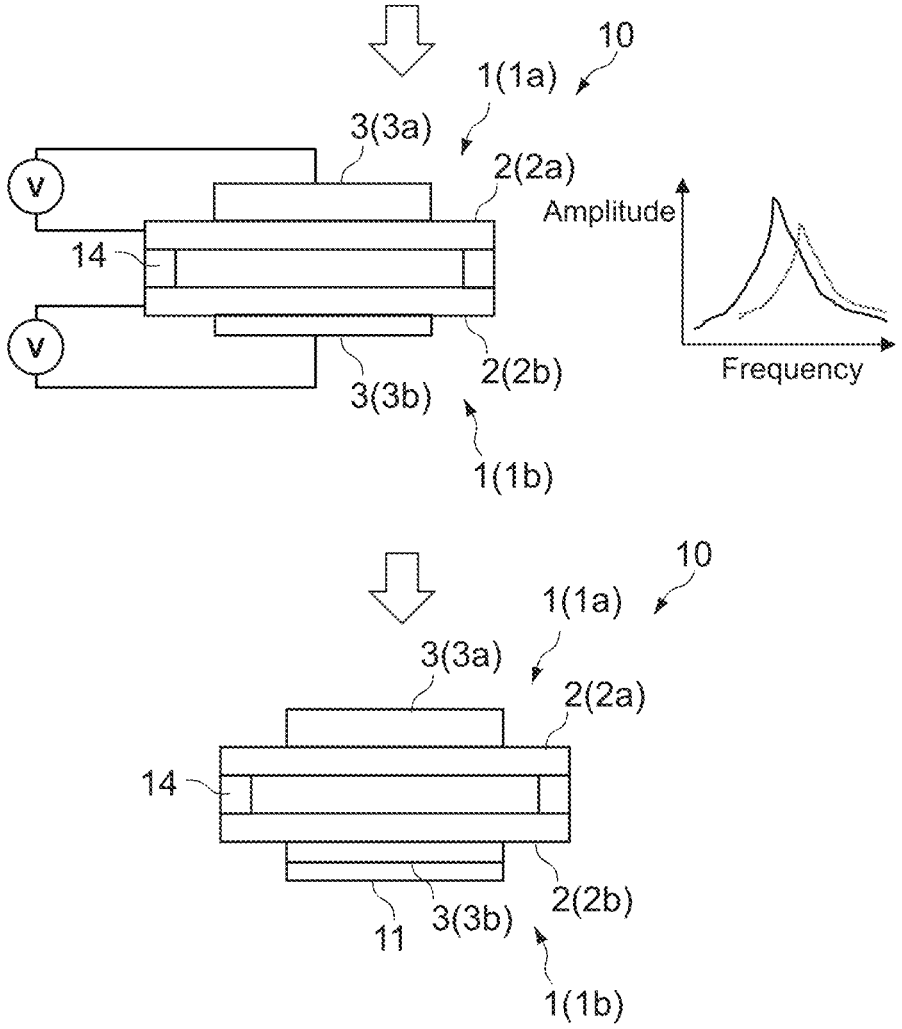
FIG. 8B is a diagram showing a manufacturing method for the diaphragm pump according to the first embodiment (manufacturing process).

FIG. 7 is a diagram showing a manufacturing apparatus for the diaphragm pump 10 according to the first embodiment. FIGS. 8A and 8B are diagrams showing a manufacturing method (manufacturing process) for the diaphragm pump 10 according to the first embodiment. Note that FIGS. 8A and 8B illustrate a simplified diaphragm pump 10.

As shown in FIG. 7, the manufacturing apparatus 30 includes a diaphragm generation unit 31, a first measurement unit 32, a pairing unit 33, an assembly unit 34, a second measurement unit 35, an adjustment portion formation unit 36, and a control apparatus 37.

The diaphragm generation unit 31 forms a piezoelectric element 3 at a position, which corresponds to an elastic portion of a plate member 2 (e.g., bonds and fixes the piezoelectric element 3 to the elastic portion 5), so that a diaphragm 1 is generated (see the top and second top diagrams of FIG. 8A). The diaphragm generation unit 31 then transfers the generated diaphragm 1 to the first measurement unit 32 in sequence.

Note that the diaphragm generation unit 31 may form a groove 7 in the plate member 2 and form a spring portion 6 in the plate member 2. Either one of the step of forming the spring portion 6 and the step of forming the piezoelectric element 3 may be performed first.

The first measurement unit 32 applies an input voltage (sine waves and the like) to the piezoelectric element 3 of the diaphragm 1 transferred from the diaphragm generation unit 31 and vibrates the diaphragm 1. The first measurement unit 32 then measures frequency characteristics (resonant frequency) and amplitude characteristics of the diaphragm 1 (see the third top diagram of FIG. 8A).

Further, the first measurement unit 32 outputs information of the measured frequency characteristics and amplitude characteristics to the control apparatus 37. The first measurement unit 32 then transfers the diaphragm 1, for which the measurement has been completed, to the pairing unit 33 in sequence.

The first measurement unit 32 is constituted by, for example, a Doppler displacement meter, but may be constituted by any apparatus as long as it is an apparatus capable of measuring frequency characteristics and amplitude characteristics of the diaphragm 1.

The pairing unit 33 is capable of storing a plurality of diaphragms 1 transferred from the first measurement unit 32 (e.g., approximately 10 to 100 pieces: at least three pieces or more). Such a pairing unit 33 pairs two diaphragms 1 having close frequency characteristics (resonant frequency) and amplitude characteristics from the plurality of diaphragms 1 stored, and selects them as a first diaphragm 1*a* and a second diaphragm 1*b* (see the second diagram from the bottom of FIG. 8A).

Note that the pairing unit 33 performs such a paring operation in response to a command from the control apparatus 37, which stores the frequency characteristics and amplitude characteristics of each diaphragm 1. Further, the pairing unit 33 transfers the two paired diaphragms 1 to the assembly unit 34 in sequence.

The assembly unit 34 fixes one diaphragm 1 of the two diaphragms 1 transferred from the pairing unit 33 to the upper surface of a cylindrical body 14, and fixes the other diaphragm 1 to the lower surface of the cylindrical body 14, thus assembling a diaphragm pump 10 (see the bottom diagram of FIG. 8A). The assembly unit 34 then transfers the assembled diaphragm pump 10 to the second measurement unit 35 in sequence.

The second measurement unit 35 applies an input voltage (sine waves and the like) to the first piezoelectric element 3*a* and the second piezoelectric element 3*b* of the diaphragm pump 10 transferred from the diaphragm generation unit 31, and vibrates the first diaphragm 1*a* and the second diaphragm 1*b*. The first measurement unit 32 then measures frequency characteristics (resonant frequency) and amplitude characteristics for each of the first diaphragm 1*a* and the second diaphragm 1*b* (see the top diagram of FIG. 8B).

Further, the second measurement unit 35 outputs information of the measured frequency characteristics and amplitude characteristics to the control apparatus 37. The second measurement unit 35 then transfers the diaphragm pump 10, for which the measurement has been completed, to the adjustment portion formation unit 36 in sequence.

The second measurement unit 35 is constituted by, for example, a Doppler displacement meter, but may be constituted by any apparatus as long as it is an apparatus capable of measuring frequency characteristics and amplitude characteristics of the diaphragm 1.

The adjustment portion formation unit 36 forms an adjustment portion 11 on one of the first diaphragm 1*a* and the second diaphragm 1*b* (first piezoelectric element 3*a* and second piezoelectric element 3*b*) of the diaphragm pump 10 transferred from the second measurement unit 35 in response to a command from the control apparatus 37. Description on one of the first diaphragm 1*a* and the second diaphragm 1*b* (first piezoelectric element 3*a* and second piezoelectric element 3*b*), to which the adjustment portion 11 is to be provided, and the amount (thickness) of the adjustment portion 11 to be provided will be given later in detail.

The control apparatus 37 collectively controls the entire manufacturing apparatus 30. The control apparatus 37 includes a controller and storage. The controller is constituted by, for example, a central processing unit (CPU) or the like. The storage includes a volatile memory used as an operation area of the controller and a nonvolatile memory that stores various types of data, programs, and the like. The control apparatus 37 may be constituted by a general-purpose apparatus such as a PC or may be constituted by a dedicated apparatus for the manufacturing apparatus 30.

The control apparatus 37 determines which diaphragms 1 have close frequency characteristics (resonant frequency) and amplitude characteristics on the basis of the frequency characteristics (resonant frequency) and amplitude characteristics of each diaphragm 1, which are acquired from the first measurement unit 32. The control apparatus 37 then outputs a command to the pairing unit 33 and causes the pairing unit 33 to pair two diaphragms 1.

Further, the control apparatus 37 determines how much of the adjustment portions 11 is to be formed on which one of the first diaphragm 1*a* and the second diaphragm 1*b* (first piezoelectric element 3*a* and second piezoelectric element 3*b*) on the basis of the frequency characteristics (resonant frequency) and amplitude characteristics of the first diaphragm 1*a* and the second diaphragm 1*b*, which are acquired from the second measurement unit 35. The controller then outputs a command to the adjustment portion formation unit 36 and causes the adjustment portion formation unit 36 to form the adjustment portion 11.

<How Much of Adjustment Portion 11 Is To Be Formed On Which One of Diaphragms 1>

Next, description will be given on how much of the adjustment portion 11 is to be formed on which one of the first diaphragm 1*a* and the second diaphragm 1*b*.

Figure 9:
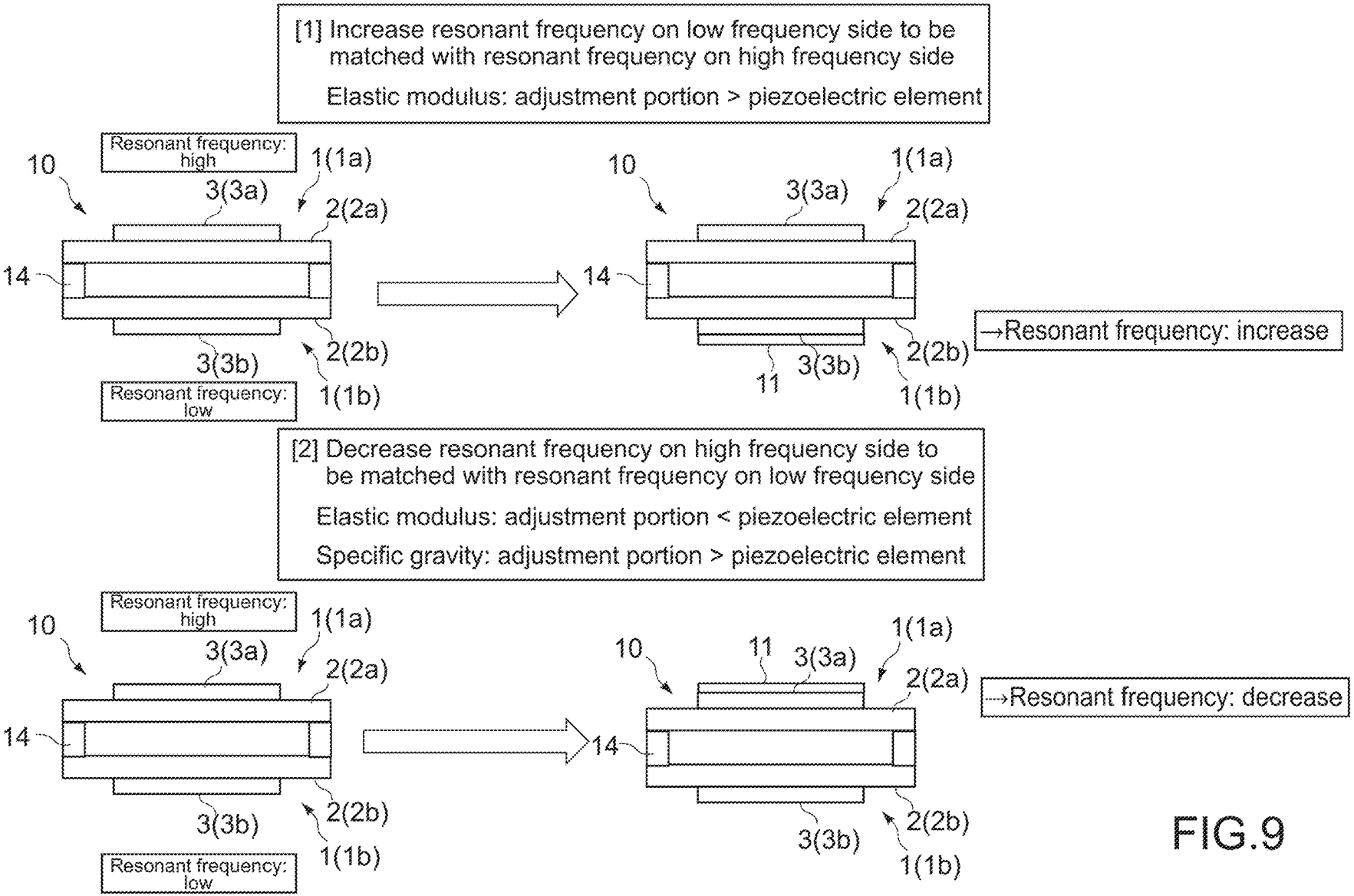
FIG. 9 is a diagram showing two patterns of a method of combining a resonant frequency of a first diaphragm and a resonant frequency of a second diaphragm.

First, there are two patterns for a method of matching the resonant frequency of the first diaphragm 1*a* and the resonant frequency of the second diaphragm 1*b*. FIG. 9 is a diagram showing two patterns for a method of matching the resonant frequency of the first diaphragm 1*a* and the resonant frequency of the second diaphragm 1*b*.

Referring to the upper part of FIG. 9, a first pattern is a pattern in which a resonant frequency of a diaphragm 1 on a low frequency side in the first diaphragm 1*a* and the second diaphragm 1*b* is increased so as to match the resonant frequency of the diaphragm 1 on the low frequency side with the resonant frequency of the diaphragm 1 on a high frequency side.

In the case of the first pattern, the adjustment portion 11 is formed on a piezoelectric element 3 of the diaphragm 1 on the low frequency side. Further, in order to increase the resonant frequency of the diaphragm 1, a material having a higher elastic modulus than that of the material of the piezoelectric element is used as the material used for the adjustment portion 11. Note that the simulation result reveals that, if the adjustment portion 11 is formed of a material having a physical property value equivalent to that of solder, the resonant frequency can be increased efficiently and easily.

Referring to the lower part of FIG. 9, a second pattern is a pattern in which a resonant frequency of a diaphragm 1 on a high frequency side in the first diaphragm 1*a* and the second diaphragm 1*b* is decreased so as to match the resonant frequency of the diaphragm 1 on the high frequency side with the resonant frequency of the diaphragm 1 on a low frequency side.

In the case of the second pattern, the adjustment portion 11 is formed on a piezoelectric element 3 of the diaphragm 1 on the high frequency side. Further, in order to decrease the resonant frequency of the diaphragm 1, a material having a lower elastic modulus and a higher specific gravity than those of the material of the piezoelectric element is used as the material for the adjustment portion 11.

Next, the amount (thickness) of the adjustment portion 11 will be described. First, the amount of the adjustment portion 11 is changed in advance, and when the adjustment portion 11 with that amount is formed, the degree of change in the resonant frequency of the diaphragm 1 is measured. Thus, a relationship between the amount of the adjustment portion 11 and a change rate of the resonant frequency of the diaphragm 1 is aggregated statistically.

The difference between the resonant frequency of the first diaphragm 1*a* and the resonant frequency of the second diaphragm 1*b* is then calculated, and the amount of the adjustment portion 11 for compensating for the difference is determined on the basis of the relationship. Note that, as the difference between the resonant frequency of the first diaphragm 1*a* and the resonant frequency of the second diaphragm 1*b* becomes larger, the amount (thickness) of the adjustment portion 11 is increased.

The processing of the control apparatus 37 will be specifically described with an example. First, the first pattern will be described. The control apparatus 37 stores in advance the relationship between the amount (thickness) of the adjustment portion 11 and the change rate of the resonant frequency of the diaphragm 1. The control apparatus 37 determines which diaphragm 1 has a smaller resonant frequency when acquiring the resonant frequency (frequency characteristics) of the first diaphragm 1*a* and the resonant frequency (frequency characteristics) of the second diaphragm 1*b* from the second measurement unit 35. The control apparatus 37 then determines the diaphragm 1 having a smaller resonant frequency as a diaphragm 1 on which the adjustment portion 11 is to be formed.

Next, the control apparatus 37 calculates the difference between the resonant frequency of the first diaphragm 1*a* and the resonant frequency of the second diaphragm 1*b*. The control apparatus 37 then determines the amount (thickness) of the adjustment portion 11 on the basis of the relationship between the amount (thickness) of the adjustment portion 11 and the change rate of the resonant frequency, and the difference in the resonant frequency. The control apparatus 37 then notifies the adjustment portion formation unit 36 of information indicating a diaphragm 1, on which the adjustment portion 11 is to be formed, and information indicating the amount of the adjustment portion 11, and causes the adjustment portion formation unit 16 to form the adjustment portion 11. Note that the adjustment portion 11 at that time has a higher elastic modulus than that of the piezoelectric element.

Next, the second pattern will be described. The control apparatus 37 stores in advance the relationship between the amount (thickness) of the adjustment portion 11 and the change rate of the resonant frequency of the diaphragm 1. The control apparatus 37 determines which diaphragm 1 has a larger resonant frequency when acquiring the resonant frequency (frequency characteristics) of the first diaphragm 1*a* and the resonant frequency (frequency characteristics) of the second diaphragm 1*b* from the second measurement unit 35. The control apparatus 37 then determines the diaphragm 1 having a larger resonant frequency as a diaphragm 1 on which the adjustment portion 11 is to be formed.

Next, the control apparatus 37 calculates the difference between the resonant frequency of the first diaphragm 1*a* and the resonant frequency of the second diaphragm 1*b*. The control apparatus 37 then determines the amount (thickness) of the adjustment portion 11 on the basis of the relationship between the amount (thickness) of the adjustment portion 11 and the change rate of the resonant frequency, and the difference in the resonant frequency. The control apparatus 37 then notifies the adjustment portion formation unit 36 of information indicating a diaphragm 1, on which the adjustment portion 11 is to be formed, and information indicating the amount of the adjustment portion 11, and causes the adjustment portion formation unit 16 to form the adjustment portion 11. Note that the adjustment portion 11 at that time has a lower elastic modulus and a higher specific gravity than those of the piezoelectric element.

<Operation Etc.>

As described above, in this embodiment, the adjustment portion 11 is formed on the first diaphragm 1*a* or the second diaphragm 1*b*, so that the resonant frequency of the first diaphragm 1*a* and the resonant frequency of the second diaphragm 1*b* can be equalized as much as possible. This makes it possible to suitably set the vibration phases of the first diaphragm 1*a* and the second diaphragm 1*b* to be the opposite phases and to set the same time for the maximum point of the amplitude (e.g., like an ideal diaphragm pump as shown in FIG. 5). This makes it possible to improve the driving efficiency of the diaphragm pump 10.

Note that the following experimental result is obtained: when the difference in vibration frequency between the first diaphragm 1*a* and the second diaphragm 1*b* before forming the adjustment portion 11 was 600 Hz (the vibration frequency was approximately 20 kHz), and when an adjustment portion 11 having the size of approximately 0.1 mm was formed on a piezoelectric element of one of the diaphragms 1, the difference in vibration frequency was almost zero.

Further, in this embodiment, two diaphragms 1 having close resonant frequencies are selected as the first diaphragm 1*a* and the second diaphragm 1*b* from the plurality of diaphragms 1. This needs less amount of the adjustment portion 11 and makes it possible to efficiently match the resonant frequencies of the first diaphragm 1*a* and the second diaphragm 1*b* with each other.

Further, in this embodiment, if the resonant frequency of one of the diaphragms 1 is increased to match the resonant frequencies of the first diaphragm 1*a* and the second diaphragm 1*b* with each other, a material having a higher elastic modulus than that of the piezoelectric element 3 is used as the material for the adjustment portion 11. This makes it possible to suitably increase the resonant frequency of the diaphragm 1.

Further, in this embodiment, if the resonant frequency of one of the diaphragms 1 is decreased to match the resonant frequencies of the first diaphragm 1*a* and the second diaphragm 1*b* with each other, a material having a lower elastic modulus and a higher specific gravity than those of the piezoelectric element 3 is used as the material for the adjustment portion 11. This makes it possible to suitably decrease the resonant frequency of the diaphragm 1.

Further, in this embodiment, a resonant frequency (frequency characteristics) of each of the first diaphragm 1*a* and the second diaphragm 1*b* (after assembly) is measured, and on the basis of the resonant frequency, the amount (thickness) of the adjustment portion 11 is determined. This makes it possible to suitably match the resonant frequency of the first diaphragm 1*a* and the resonant frequency of the second diaphragm 1*b* with each other.

In particular, in this embodiment, the amount (thickness) of the adjustment portion 11 is determined on the basis of the difference in resonant frequency between the first diaphragm 1*a* and the second diaphragm 1*b* and the relationship between the amount (thickness) of the adjustment portion 11 and the change rate of the resonant frequency of the diaphragm 1. This makes it possible to more suitably match the resonant frequency of the first diaphragm 1*a* and the resonant frequency of the second diaphragm 1*b* with each other.

Second Embodiment

Next, a second embodiment of the present technology will be described. Here, according to the adjustment portion 11 described above, the resonant frequency of the first diaphragm 1*a* and the resonant frequency of the second diaphragm 1*b* can be equalized as much as possible, and a phase shift from the opposite phase in the vibrations of the first diaphragm 1*a* and the second diaphragm 1*b* is reduced, but the phase shift may remain.

In this regard, in the second embodiment, the phase control of an input voltage (input signal: sine waves and the like) is performed on the basis of a phase difference between the opposite phases of the vibrations of the first diaphragm 1*a* and the second diaphragm 1*b*. This causes the vibrations of the first diaphragm 1*a* and the second diaphragm 1*b* to be approximated to have the opposite phases without limit.

<Basic Concept>

Figure 10:
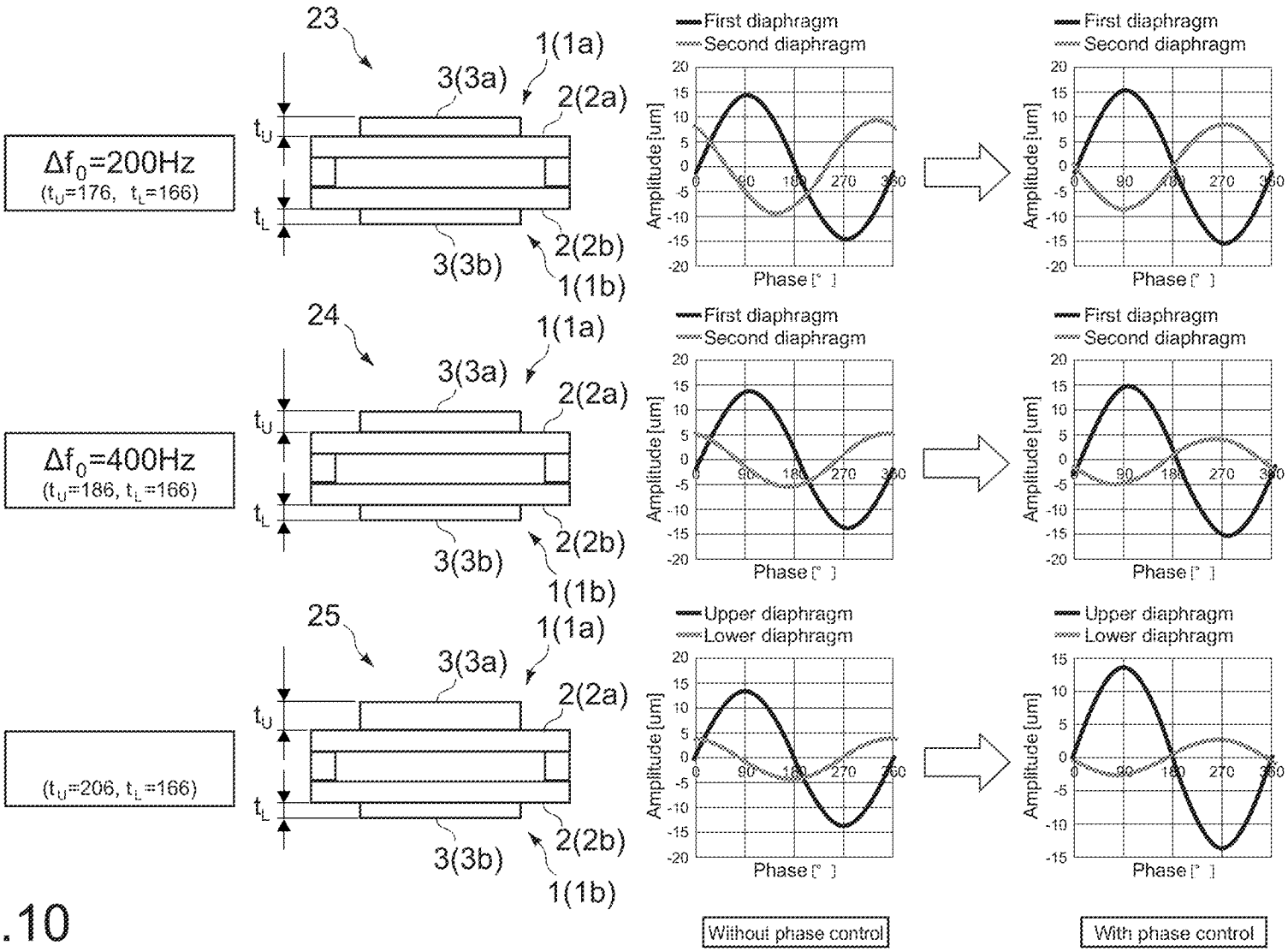
FIG. 10 is a diagram showing a relationship between vibrations of the diaphragm and cases where phase control is not performed and where phase control is performed in the diaphragm pumps according to respective comparative examples.

First, a basic concept of the second embodiment will be described with comparative examples. FIG. 10 is a diagram showing a relationship between the vibrations of the diaphragm 1 and cases where phase control is not performed and where phase control is performed in diaphragm pumps 23 to 25 according to respective comparative examples (third comparative example to fifth comparative example). Note that FIG. 10 illustrates simplified diaphragm pumps 23 to 25. Further, the comparative examples of FIG. 10 do not include the adjustment portions 11.

First, referring to the upper diagram of FIG. 10, the diaphragm pump 23 according to the third comparative example will be described. In this diaphragm pump 23 according to the third comparative example, a first piezoelectric element 3*a* has a thickness $t_U$ of 176 μm, and a second piezoelectric element 3*b* has a thickness $t_L$ of 166 μm, and thus the resonant frequencies of the first diaphragm 1*a* and the second diaphragm 1*b* do not coincide with each other.

Hence, when input voltage with the opposite phases (which are not subjected to phase control and are simple) are applied to the first piezoelectric element 3*a* and the second piezoelectric element 3*b*, a difference (Of) of 200 Hz is generated between the vibration frequency of the first diaphragm 1*a* and the vibration frequency of the second diaphragm 1*b*. Note that the vibration frequencies of the first diaphragm 1*a* and the second diaphragm 1*b* are each approximately 20 kHz, and further, the first diaphragm 1*a* has a higher frequency.

Further, the vibration phase of the first diaphragm 1*a* and the vibration phase of the second diaphragm 1*b* are not suitably opposite to each other, and thus a phase difference (shift amount from the opposite phase) is generated.

In the third comparative example, the vibration phase of the second diaphragm 1*b* is advanced by approximately 50° with respect to the opposite phase of the vibration of the first diaphragm 1*a*. Thus, in the phase control, the processing of delaying the phase of the input voltage of the second piezoelectric element 3*b* by 50° with respect to the opposite phase of the input voltage of the first piezoelectric element 3*a* is performed. By such phase control, the vibration phase of the first diaphragm 1*a* and the vibration phase of the second diaphragm 1*b* can be suitably set to be the opposite phases.

Next, referring to the middle diagram of FIG. 10, the diaphragm pump 24 according to the fourth comparative example will be described. In this diaphragm pump 24 according to the fourth comparative example, a first piezoelectric element 3*a* has a thickness $t_U$ of 186 μm, and a second piezoelectric element 3*b* has a thickness $t_L$ of 166 μm, and thus the resonant frequencies of the first diaphragm 1*a* and the second diaphragm 1*b* do not coincide with each other.

Hence, when input voltages with the opposite phases (which are not subjected to phase control and are simple) are applied to the first piezoelectric element 3*a* and the second piezoelectric element 3*b*, a difference (Of) of 400 Hz is generated between the vibration frequency of the first diaphragm 1*a* and the vibration frequency of the second diaphragm 1*b*. Note that the vibration frequencies of the first diaphragm 1*a* and the second diaphragm 1*b* are each approximately 20 kHz, and further, the first diaphragm 1*a* has a higher frequency.

Further, the vibration phase of the first diaphragm 1*a* and the vibration phase of the second diaphragm 1*b* are not suitably opposite to each other, and thus a phase difference (shift amount from the opposite phase) is generated.

In the fourth comparative example, the vibration phase of the second diaphragm 1*b* is advanced by approximately 80° with respect to the opposite phase of the vibration of the first diaphragm 1*a*. Thus, in the phase control, the processing of delaying the phase of the input voltage of the second piezoelectric element 3*b* by 80° with respect to the opposite phase of the input voltage of the first piezoelectric element 3*a* is performed. By such phase control, the vibration phase of the first diaphragm 1*a* and the vibration phase of the second diaphragm 1*b* can be suitably set to be the opposite phases.

Next, referring to the lower diagram of FIG. 10, the diaphragm pump 25 according to the fifth comparative example will be described. In this diaphragm pump 25 according to the fifth comparative example, a first piezoelectric element 3*a* has a thickness $t_U$ of 206 μm, and a second piezoelectric element 3*b* has a thickness $t_L$ of 166 μm, and thus the resonant frequencies of the first diaphragm 1*a* and the second diaphragm 1*b* do not coincide with each other.

Hence, when input voltages of the opposite phases (which are not subjected to phase control and are simple) are applied to the first piezoelectric element 3*a* and the second piezoelectric element 3*b*, a difference (Of) of 1000 Hz is generated between the vibration frequency of the first diaphragm 1*a* and the vibration frequency of the second diaphragm 1*b*. Note that the vibration frequencies of the first diaphragm 1*a* and the second diaphragm 1*b* are each approximately 20 kHz, and further, the first diaphragm 1*a* has a higher frequency.

Further, the vibration phase of the first diaphragm 1*a* and the vibration phase of the second diaphragm 1*b* are not suitably opposite to each other, and thus a phase difference (shift amount from the opposite phase) is generated.

In the fourth comparative example, the vibration phase of the second diaphragm 1*b* is advanced by approximately 90° with respect to the opposite phase of the vibration of the first diaphragm 1*a*. Thus, in the phase control, the processing of delaying the phase of the input voltage of the second piezoelectric element 3*b* by 90° with respect to the opposite phase of the input voltage of the first piezoelectric element 3*a* is performed. By such phase control, the vibration phase of the first diaphragm 1*a* and the vibration phase of the second diaphragm 1*b* can be suitably set to be the opposite phases.

Note that, in this example, the case where the processing of shifting the phase of the input voltage of the second piezoelectric element 3*b* is performed in the phase control has been described, but the phase of the input voltage of the first piezoelectric element 3*a* may be shifted. Alternatively, the phase of the input voltage of the first piezoelectric element 3*a* and the phase of the second input voltage may be both shifted to perform the phase control.

Figure 11:
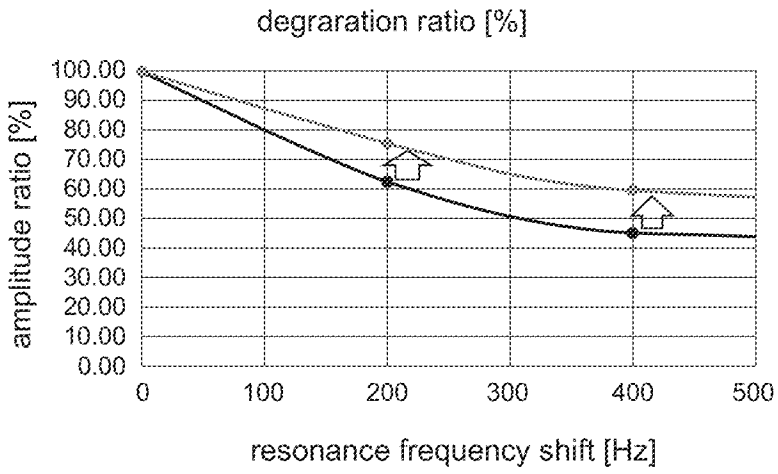
FIG. 11 is a diagram showing how much effect is obtained when phase control is performed in third to fifth comparative examples.
Figure 11:
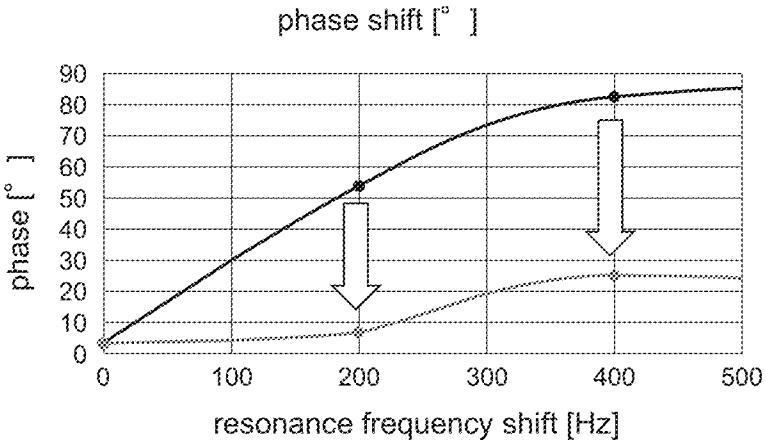

FIG. 11 is a diagram showing how much effect is obtained when the phase control is performed in the third comparative example to the fifth comparative example.

Referring to the left diagram of FIG. 11, the horizontal axis of this diagram represents a difference (Of) between the vibration frequency of the first diaphragm 1*a* and the vibration frequency of the second diaphragm 1*b*. Further, the vertical axis represents a phase difference with respect to the opposite phase in the vibrations of the first diaphragm 1*a* and the second diaphragm 1*b*.

Further, a black line indicates a graph of a case where the phase control is not performed, and a gray line indicates a graph of a case where the phase control is performed. It is found from the left diagram of FIG. 11 that a phase difference from the opposite phase in the vibrations of the first diaphragm 1*a* and the second diaphragm 1*b* falls within 25°.

Referring to the right diagram of FIG. 11, the horizontal axis of this diagram represents a difference (Of) between the vibration frequency of the first diaphragm 1*a* and the vibration frequency of the second diaphragm 1*b*. Further, the vertical axis represents a ratio (hereinafter, effective amplitude) of an amplitude of the first diaphragm 1*a* at a timing at which the first diaphragm 1*a* has a maximum amplitude to an amplitude of the second diaphragm 1*b*.

Further, a black line indicates a graph of a case where the phase control is not performed, and a gray line indicates a graph of a case where the phase control is performed. It is found from the right diagram of FIG. 11 that the effective amplitude is improved by approximately 15% at a maximum when the phase control is performed.

<Manufacturing Apparatus 30 and Manufacturing Method>

Next, a manufacturing apparatus 40 and a manufacturing method for the diaphragm pump 10 according to the second embodiment will be described.

Figure 12:
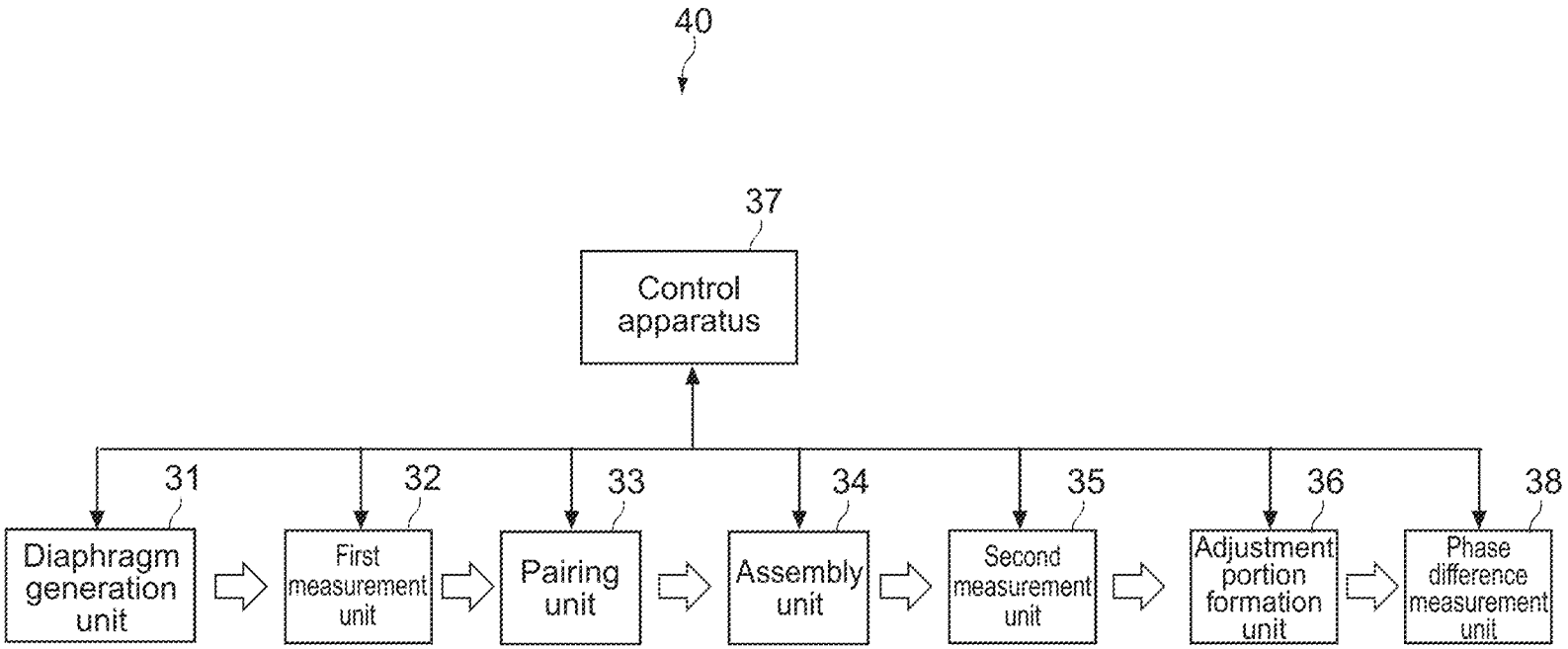
FIG. 12 is a diagram showing a manufacturing apparatus for a diaphragm pump according to a second embodiment.
Figure 13A:
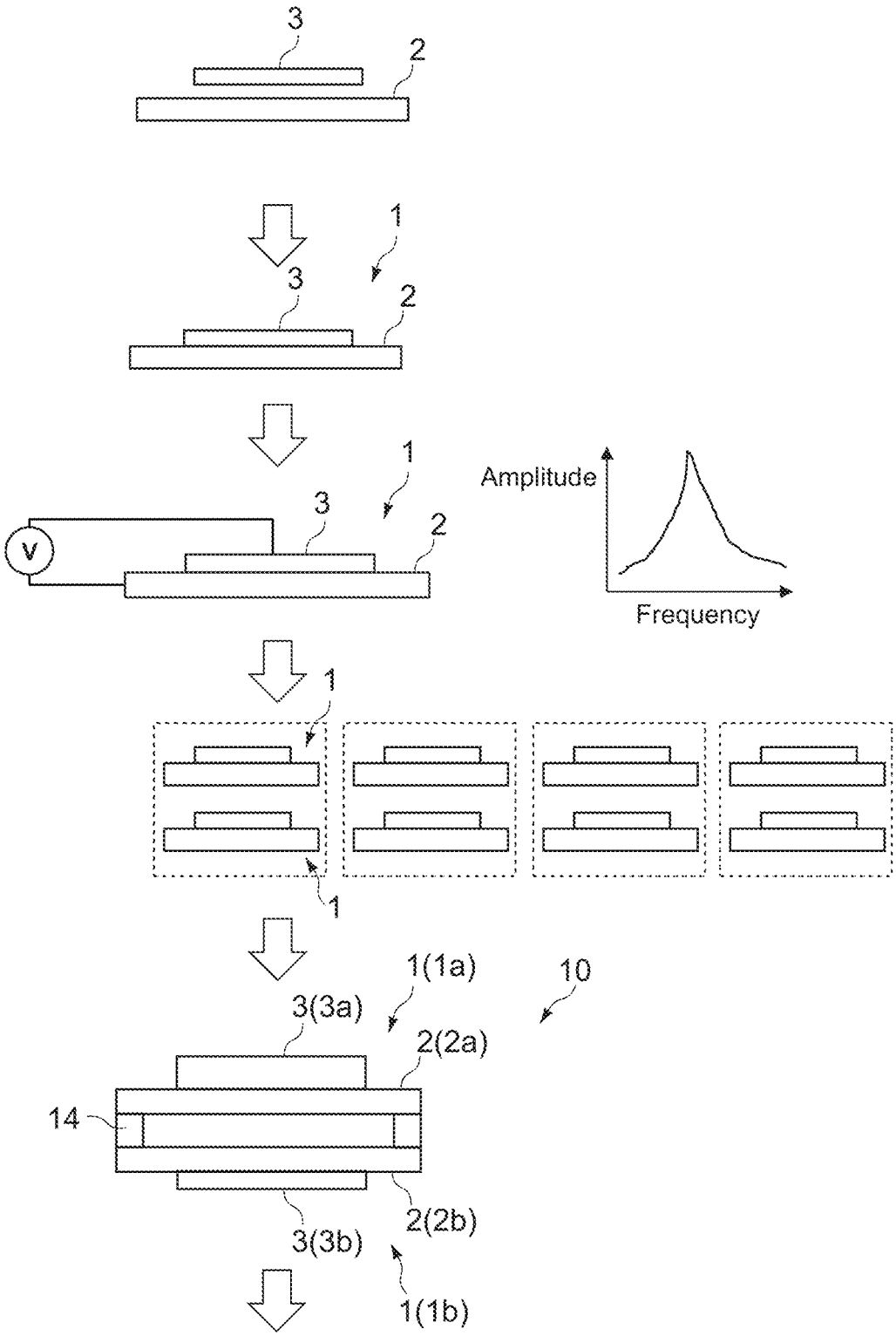
FIG. 13A is a diagram showing a manufacturing method for a diaphragm pump 10 according to the second embodiment.
Figure 13B:
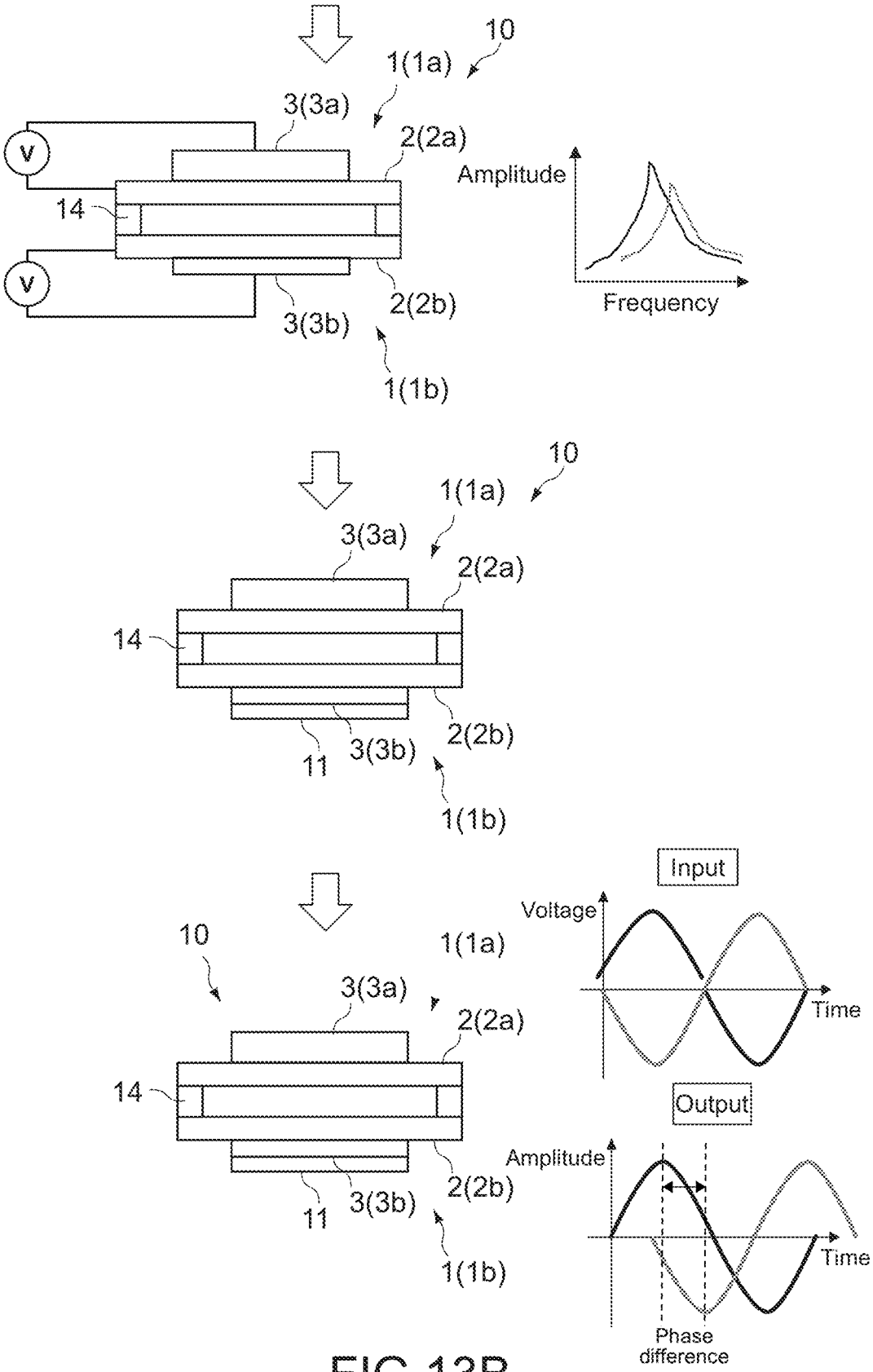
FIG. 13B is a diagram showing a manufacturing method for the diaphragm pump 10 according to the second embodiment.

FIG. 12 is a diagram showing the manufacturing apparatus 40 for the diaphragm pump 10 according to the second embodiment. FIGS. 13A and 13B are diagrams showing a manufacturing method for the diaphragm pump 10 according to the second embodiment.

The manufacturing apparatus 40 according to the second embodiment shown in FIG. 12 is different from the first embodiment (FIG. 7) described above in that a phase difference measurement unit 38 is further added at a subsequent stage of the adjustment portion formation unit 36. Further, the manufacturing method according to the second embodiment shown in FIGS. 13A and 13B is different from the first embodiment (FIGS. 8A and 8B) described above in that the step of measuring a phase difference is added at the last step. The others are similar to those of the first embodiment.

Referring to FIG. 12 and the lowest diagram of FIG. 13B, when the phase difference measurement unit 38 receives the diaphragm pump 10 (on which the adjustment portion 11 has been formed) from the adjustment portion formation unit 36, the phase difference measurement unit 38 applies input voltages with the opposite phases (sine waves and the like) to the first piezoelectric element 3*a* and the second piezoelectric element 3*b* and causes the first diaphragm 1*a* and the second diaphragm 1*b* to vibrate.

The phase difference measurement unit 38 then measures waveforms of the vibrations of the first diaphragm 1*a* and the second diaphragm 1*b* and measures a phase difference between the opposite phases in the vibrations of the first diaphragm 1*a* and the second diaphragm 1*b*. Note that the lowest diagram of FIG. 13B exaggeratedly expresses a phase difference between the opposite phases in the vibrations of the first diaphragm 1*a* and the second diaphragm 1*b* in order to perform display in an easily understood manner, but actually the adjustment portion 11 is formed and thus a large phase difference is not generated.

Note that the phase difference measurement unit 38 outputs the information of the measured phase difference, as an eigenvalue of the diaphragm pump 10, to the control apparatus 37. The information of the phase difference is stored in, for example, a memory chip (not shown) provided to the diaphragm pump 10. When the diaphragm pump 10 is mounted on an electronic apparatus or the like and used actually, the information of the phase difference is read from the memory chip and is used as the information of the phase control.

The phase difference measurement unit 38 is constituted by, for example, a Doppler displacement meter, but may be constituted by any apparatus as long as it is an apparatus capable of measuring waveforms of the vibrations of the first diaphragm 1*a* and the second diaphragm 1*b*.

<Operation Etc.>

In the diaphragm pump 10 according to the second embodiment, the phase control based on a phase difference is performed, so that the vibrations of the first diaphragm 1*a* and the second diaphragm 1*b* can be approximated to have the opposite phases without limit. This makes it possible to further improve the driving efficiency of the diaphragm pump 10.

Various Modified Examples

Next, various modified examples according to the present technology will be described.

<Position of Adjustment Portion 11>

In the embodiments described above, the case where the adjustment portion 11 is provided to the piezoelectric element 3 has been described. Meanwhile, the adjustment portion 11 may be provided to a position other than the piezoelectric element 3 in the diaphragm 1.

Figure 14:
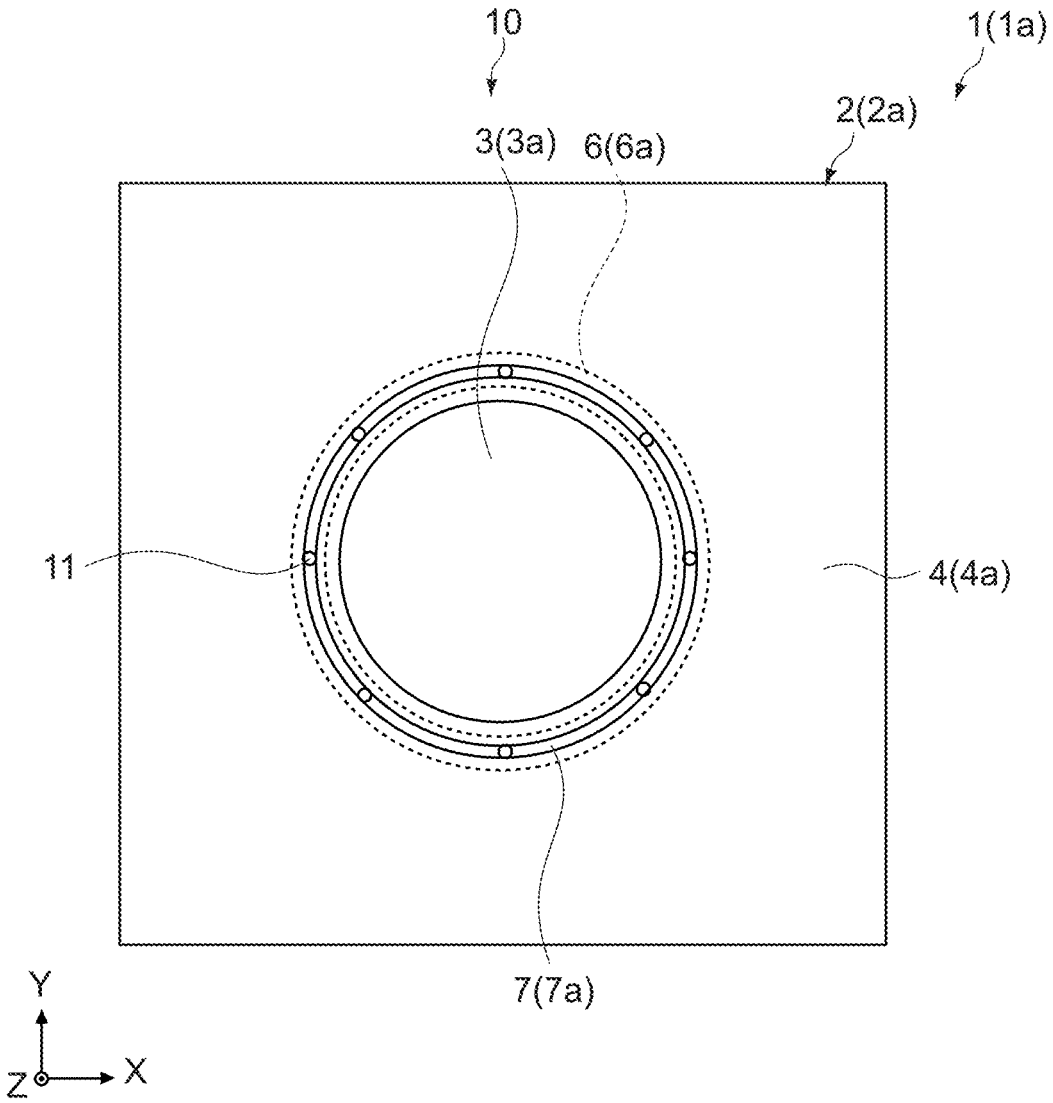
FIG. 14 is a diagram showing an example when an adjustment portion is formed in a spring portion of the diaphragm.

FIG. 14 is a diagram showing an example when the adjustment portion 11 is formed on the spring portion 6 of the diaphragm 1. In the example shown in FIG. 14, circular adjustment portions 11 are scattered inside the groove 7 in the spring portion 6. Note that the shape of the adjustment portion 11 is not limited to the circular shape and can be appropriately changed. Further, in the example shown in FIG. 14, the number of adjustment portions 11 is eight, but the number of adjustment portions 11 can also be appropriately changed.

As shown in FIG. 14, even when the adjustment portion 11 is formed on the spring portion 6, the resonant frequency of the diaphragm 1 can be suitably adjusted. This makes it possible to suitably match the resonant frequency of the first diaphragm 1*a* and the resonant frequency of the second diaphragm 1*b* with each other.

Here, in the case of the pattern in which the resonant frequency of a diaphragm 1 on a low frequency side is increased to match the resonant frequencies of the two diaphragms 1, an adjustment portion 11 formed of a material having a higher elastic modulus than that of the spring portion 6 is formed on the spring portion 6 of the diaphragm 1 on the low resonant frequency side.

Further, in the case of the pattern in which the resonant frequency of a diaphragm 1 on a high frequency side is decreased to match the resonant frequencies of the two diaphragms 1, an adjustment portion 11 formed of a material having a lower elastic modulus and a higher specific gravity than those of the spring portion 6 is formed on the spring portion 6 of the diaphragm 1 on the high resonant frequency side.

Figure 15:
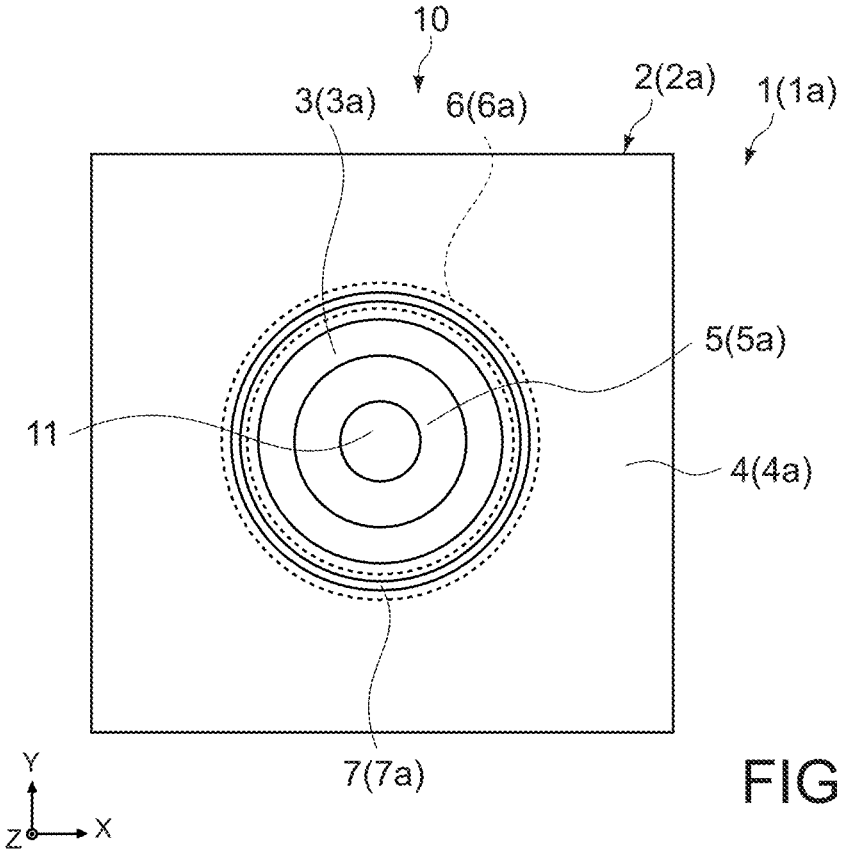
FIG. 15 is a diagram showing an example when an adjustment portion is formed in an elastic portion of the diaphragm.

FIG. 15 is a diagram showing an example when the adjustment portion 11 is formed on the elastic portion 5 of the diaphragm 1. Note that, in the example shown in FIG. 15, the piezoelectric element 3 is formed into a circular and annular shape, and the center portion of the elastic portion 5 is exposed to the outside. FIG. 15 shows an example of a case where a circular adjustment portion 11 is formed at the center position of a region exposed to the outside in the elastic portion.

Note that the shape of the adjustment portion 11 is not limited to be circular and can be appropriately changed. Further, in the example shown in FIG. 115, the number of adjustment portions 11 is one, but the number of adjustment portions 11 can also be appropriately changed.

As shown in FIG. 15, even when the adjustment portion 11 is formed on the elastic portion 5, the resonant frequency of the diaphragm 1 can be suitably adjusted. This makes it possible to suitably match the resonant frequency of the first diaphragm 1*a* and the resonant frequency of the second diaphragm 1*b* with each other.

Here, in the case of the pattern in which the resonant frequency of a diaphragm 1 on a low frequency side is increased to match the resonant frequencies of the two diaphragms 1, an adjustment portion 11 formed of a material having a higher elastic modulus than that of the elastic portion 5 is formed on the elastic portion 5 of the diaphragm 1 on the low resonant frequency side.

Further, in the case of the pattern in which the resonant frequency of a diaphragm 1 on a high frequency side is decreased to match the resonant frequencies of the two diaphragms 1, an adjustment portion 11 formed of a material having a lower elastic modulus (and a higher specific gravity) than that of the elastic portion 5 is formed on the elastic portion 5 of the diaphragm 1 on the high resonant frequency side.

Note that, regardless of the position where the adjustment portion 11 is provided, the adjustment portion 11 is symmetrically formed about the center of the diaphragm 1 (in the horizontal direction), so that the resonant frequency can be suitably adjusted.

Further, the adjustment portion 11 may be provided at two or more locations among the piezoelectric element 3, the spring portion 6, and the elastic portion 5.

<Flexible Board (Power Feed Unit)>

Figure 16:
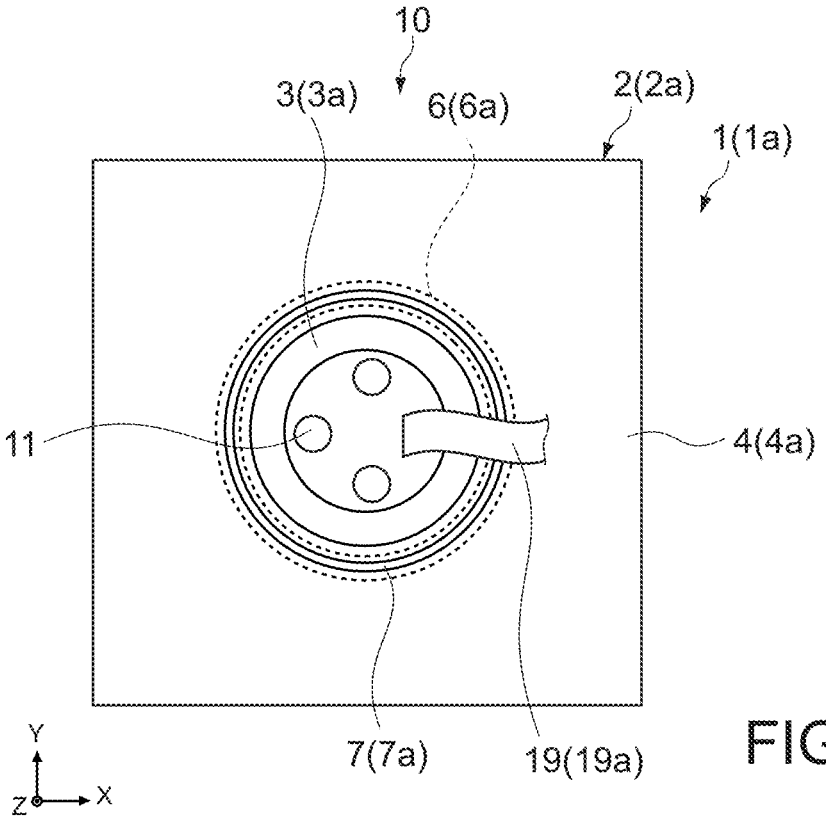
FIG. 16 is a diagram showing a state in which a flexible board that supplies power to a piezoelectric element is connected to the elastic portion.

FIG. 16 is a diagram showing a state where a flexible board 19 (power feed unit) that supplies power to the piezoelectric element 3 is connected to the elastic portion 5. The flexible board 19 includes a first flexible board 19*a* (first power feed unit) provided on a first diaphragm 1*a* side and a second flexible board 19*b* (second power feed unit) provided on a second diaphragm 1*b* side.

In the example shown in FIG. 16, the piezoelectric element 3 is formed into a circular and annular shape, and the center portion of the elastic portion 5 is exposed to the outside. In FIG. 15, the flexible board 19 is connected to a region exposed to the outside in the elastic portion 5. Further, in the region exposed to the outside in the elastic portion 5, three circular adjustment portions 11 are formed so as to uniformize the balance with the flexible board 19 (in the plane direction).

Note that the shape of the adjustment portion 11 is not limited to be circular and can be appropriately changed. Further, in the example shown in FIG. 16, the number of adjustment portions 11 is three, but the number of adjustment portions 11 is also appropriately changed.

In the example shown in FIG. 16, since the adjustment portions 11 are formed so as to uniformize the balance with the flexible board (in the plane direction), the reliability against the concentration of stress and the like can be improved.

<Adjustment Portions 11 on Both First Diaphragm 1*a* Side and Second Diaphragm 1*b* Side>

In the above description, the case where the adjustment portion 11 is provided to either the first diaphragm 1*a* or the second diaphragm 1*b* has been described. Meanwhile, the adjustment portions 11 may be provided to both the first diaphragm 1*a* and the second diaphragm 1*b*.

Figure 17:
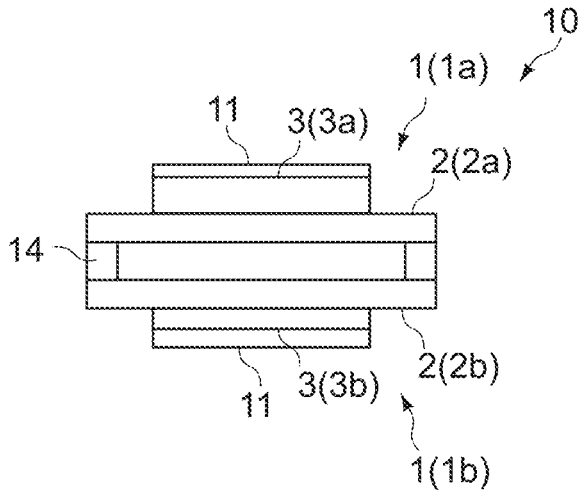
FIG. 17 is a diagram showing a state in which an adjustment portion is formed in both a first piezoelectric element and a second piezoelectric element.

FIG. 17 is a diagram showing a state in which the adjustment portions 11 are formed on both the first piezoelectric element 3*a* and the second piezoelectric element 3*b*. Note that the adjustment portions 11 may be formed on both the first spring portion 6*a* and the second spring portion 6*b* or may be formed on both the first elastic portion 5*a* and the second elastic portion 5*b*.

Note that, if a material having a higher elastic modulus than that of a portion where the adjustment portion 11 is to be provided (piezoelectric element, spring portion, elastic portion) is used as a material for the adjustment portion 11, the amount of the adjustment portion 11 to be provided to a diaphragm 1 on a low resonant frequency side is set to be larger than the amount of the adjustment portion 11 to be provided to a diaphragm 1 on a high resonant frequency side.

Meanwhile, if a material having a lower elastic modulus (and a higher specific gravity) than those of a portion where the adjustment portion 11 is to be provided (piezoelectric element, spring portion, elastic portion) is used as a material for the adjustment portion 11, the amount of the adjustment portion 11 to be provided to a diaphragm 1 on a high resonant frequency side is set to be larger than the amount of the adjustment portion 11 to be provided to a diaphragm 1 on a low resonant frequency side.

Note that the adjustment portion 11 may be formed at a different portion in the first diaphragm 1*a* and the second diaphragm 1*b*. For example, the adjustment portion 11 may be provided to the first piezoelectric element 3*a* on the first diaphragm 1*a* side, and may be provided to the second elastic portion 5*b* on the second diaphragm 1*b* side (the combination is freely determined).

In addition, the adjustment portion 11 may be provided at two or more locations selected from the first piezoelectric element 3*a*, the first spring portion 6*a*, and the first elastic portion 5*a* on the first diaphragm 1*a* side, and may be provided at two or more locations selected from the second piezoelectric element 3*b*, the second spring portion 6*b*, and the second elastic portion 5*b* on the second diaphragm 1*b* side.

<Others>

Figure 18:
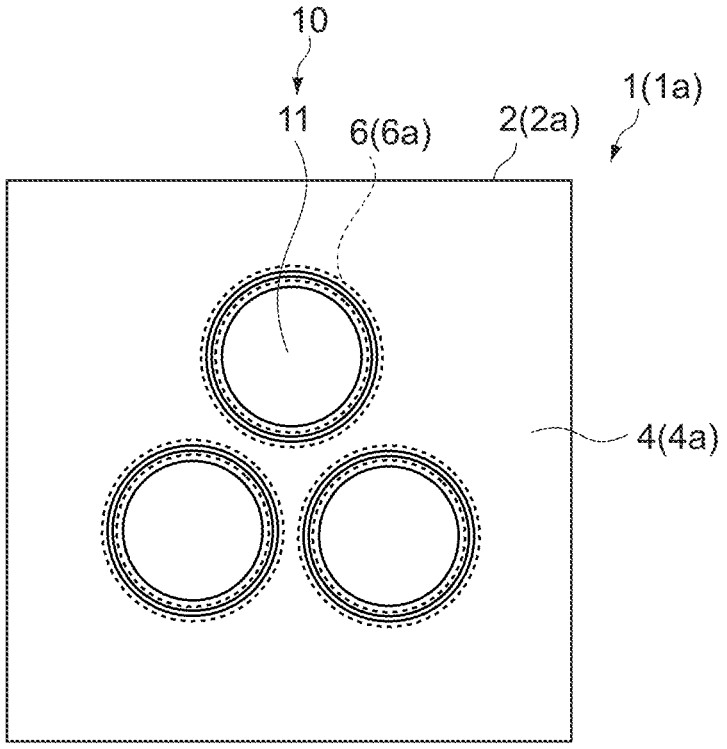
FIG. 18 is a diagram showing another example of a diaphragm pump.

FIG. 18 is a diagram showing another example of the diaphragm pump 10. In the example shown in FIG. 18, each of the first diaphragm 1*a* and the second diaphragm 1*b* includes three piezoelectric elements 3, three spring portions 6, and three elastic portions 5. Further, in the example shown in FIG. 18, the adjustment portions 11 are formed on all of the three piezoelectric elements 3.

Note that, in the example shown in FIG. 18, the number of piezoelectric elements 3, the number of spring portions 6, and the number of elastic portions 5 are each three per diaphragm 1, but this number only needs to be two or more. Further, in the example shown in FIG. 18, the adjustment portions 11 are provided to all the three piezoelectric elements 3, but the adjustment portions 11 may be provided to some piezoelectric elements in the three piezoelectric elements 3. Note that the adjustment portion 11 may be provided to the three spring portions 6 (some or all thereof), and further, the adjustment portion 11 may be provided to the three elastic portions 5 (some or all thereof; in this case, the piezoelectric element 3 is circular and annular, for example).

The present technology can have the following configurations.

(1) A diaphragm pump, including:
- a first diaphragm including
  - a first member including a first elastic portion, and
  - a first drive unit that elastically deforms the first elastic portion by drive of the first drive unit;
- a second diaphragm including
  - a second member that includes a second elastic portion and forms a space with the first member, a fluid flowing in the space, and
  - a second drive unit that elastically deforms the second elastic portion; and
- an adjustment portion that is provided to at least one of the first diaphragm or the second diaphragm and is for adjusting a resonant frequency of the at least one of the first diaphragm or the second diaphragm.

(2) The diaphragm pump according to (1), in which
- the adjustment portion is provided to at least one of the first drive unit or the second drive unit.

(3) The diaphragm pump according to (1) or (2), in which
- the adjustment portion is provided to at least one of the first elastic portion or the second elastic portion.

(4) The diaphragm pump according to any one of (1) to (3), in which
- the first member includes a first spring portion that promotes the elastic deformation of the first elastic portion,
- the second member includes a first spring portion that promotes the elastic deformation of the second elastic portion, and
- the adjustment portion is provided to at least one of the first spring portion or the second spring portion.

(5) The diaphragm pump according to any one of (1) to (4), in which
- the adjustment portion has a higher elastic modulus than an elastic modulus of a portion to which the adjustment portion is provided.

(6) The diaphragm pump according to (5), in which
- the adjustment portion is provided to a diaphragm on a low resonant frequency side in the first diaphragm and the second diaphragm.

(7) The diaphragm pump according to any one of (1) to (4), in which
- the adjustment portion has a lower elastic modulus than an elastic modulus of a portion to which the adjustment portion is provided.

(8) The diaphragm pump according to (7), in which
- the adjustment portion has a higher specific gravity than a specific gravity of a portion to which the adjustment portion is provided.

(9) The diaphragm pump according to (7) or (8), in which
- the adjustment portion is provided to a diaphragm on a high resonant frequency side in the first diaphragm and the second diaphragm.

(10) The diaphragm pump according to any one of (1) to (9), in which
- a resonant frequency of each of a plurality of diaphragms is measured, and
- two of the plurality of diaphragms having close resonant frequencies are selected as the first diaphragm and the second diaphragm.

(11) The diaphragm pump according to any one of (1) to (10), in which
- a resonant frequency of each of the first diaphragm and the second diaphragm is measured, and
- it is determined to which one of the first diaphragm and the second diaphragm the adjustment portion is provided.

(12) The diaphragm pump according to any one of (1) to (11), in which
- a resonant frequency of each of the first diaphragm and the second diaphragm is measured, and
- an amount of the adjustment portion is adjusted on the basis of the measured resonant frequency.

(13) The diaphragm pump according to any one of (1) to (12), in which
- the first diaphragm includes a first power feed unit that supplies power to the first drive unit,
- the second diaphragm includes a second power feed unit that supplies power to the second drive unit, and
- the adjustment portion is provided to uniformize a balance with the first power feed unit or the second power feed unit in at least one of the first diaphragm or the second diaphragm.

(14) The diaphragm pump according to any one of (1) to (13), in which
- phase control in which at least one of a phase of an input signal of the first drive unit or a phase of an input signal of the second drive unit is adjusted is performed.

(15) The diaphragm pump according to (14), in which
- a phase difference between opposite phases of vibrations of a first diaphragm pump and a second diaphragm pump is measured, and
- the phase control is performed on the basis of the measured phase difference.

(16) The diaphragm pump according to any one of (1) to (15), in which
- each of the first drive unit and the second drive unit is a piezoelectric element.

(17) The diaphragm pump according to any one of (1) to (16), in which
the adjustment portion is formed by potting processing.

(18) An electronic apparatus, including
a diaphragm pump including
a first diaphragm including
a first member including a first elastic portion, and
a first drive unit that elastically deforms the first elastic portion by drive of the first drive unit,
a second diaphragm including
a second member that includes a second elastic portion and forms a space with the first member, a fluid flowing in the space, and
a second drive unit that elastically deforms the second elastic portion by drive of the second drive unit, and
an adjustment portion that is provided to at least one of the first diaphragm or the second diaphragm and is for adjusting a resonant frequency of the at least one of the first diaphragm or the second diaphragm.

(19) A manufacturing apparatus for a diaphragm pump, including
an adjustment portion formation unit that forms an adjustment portion for adjusting a resonant frequency of at least one of a first diaphragm or a second diaphragm on at least one of the first diaphragm or the second diaphragm, the first diaphragm including a first member including a first elastic portion, and a first drive unit that elastically deforms the first elastic portion by drive of the first drive unit, the second diaphragm including a second member that includes a second elastic portion and forms a space with the first member, a fluid flowing in the space, and a second drive unit that elastically deforms the second elastic portion by drive of the second drive unit.

(20) A manufacturing method for a diaphragm pump, including:
preparing
a first diaphragm including
a first member including a first elastic portion, and
a first drive unit that elastically deforms the first elastic portion by drive of the first drive unit, and
a second diaphragm including
a second member that includes a second elastic portion and forms a space with the first member, a fluid flowing in the space, and
a second drive unit that elastically deforms the second elastic portion by drive of the second drive unit; and
forming an adjustment portion for adjusting a resonant frequency of at least one of the first diaphragm or the second diaphragm on at least one of the first diaphragm or the second diaphragm.

REFERENCE SIGNS LIST

1 diaphragm
2 plate member
3 piezoelectric element
4 fixing portion
5 elastic portion
6 spring portion
10 diaphragm pump
11 adjustment portion
30, 40 manufacturing apparatus

The invention claimed is:

1. A diaphragm pump, comprising:
a first diaphragm that includes:
a first member including a first elastic portion, and
a first piezoelectric element configured to elastically deform the first elastic portion;
a second diaphragm that includes:
a second member that includes a second elastic portion, wherein a fluid flows between the first member and the second member, and
a second piezoelectric element configured to elastically deform the second elastic portion; and
an adjustment layer configured to adjust at least one of a resonant frequency of the first diaphragm or a resonant frequency of the second diaphragm, wherein
the adjustment layer is of a specific thickness, and
the specific thickness is based on each of the resonant frequency of the first diaphragm and the resonant frequency of the second diaphragm.

2. The diaphragm pump according to claim 1, wherein the adjustment layer is on at least one of the first piezoelectric element or the second piezoelectric element.

3. The diaphragm pump according to claim 1, wherein
the adjustment layer is associated with the first diaphragm, and
the resonant frequency of the first diaphragm is less than the resonant frequency of the second diaphragm.

4. The diaphragm pump according to claim 1, wherein
the adjustment layer is on the first piezoelectric element, and
an elastic modulus of the adjustment layer is less than an elastic modulus of the first piezoelectric element.

5. The diaphragm pump according to claim 4, wherein specific gravity of the adjustment layer is greater than a specific gravity of the first piezoelectric element.

6. The diaphragm pump according to claim 1, wherein
the adjustment layer is associated with the first diaphragm, and
the resonant frequency of the first diaphragm is greater than the resonant frequency of the second diaphragm.

7. The diaphragm pump according to claim 1, wherein
the diaphragm pump is associated with a control apparatus
the control apparatus measures each of the resonant frequency of the first diaphragm and the resonant frequency of the second diaphragm, and
the control apparatus determines association of the adjustment layer with one of the first diaphragm or the second diaphragm based on the each of the resonant frequency of the first diaphragm or the resonant frequency of the first diaphragm.

* * * * *